US008727073B2

(12) United States Patent
Lang et al.

(10) Patent No.: US 8,727,073 B2
(45) Date of Patent: May 20, 2014

(54) SAFETY HARNESSES, CONNECTIVE RING ATTACHMENTS FOR USE IN SAFETY HARNESSES AND BACK PADS FOR USE IN SAFETY HARNESSES

(75) Inventors: Tracy Lang, Mercer, PA (US); Preston L. Anderson, Cranberry, PA (US); John R. Frey, Franklin, PA (US); Ross Balquist, Slippery Rock, PA (US)

(73) Assignee: Honeywell International Inc., Morristown, NJ (US)

( * ) Notice: Subject to any disclaimer, the term of this patent is extended or adjusted under 35 U.S.C. 154(b) by 18 days.

(21) Appl. No.: 13/421,556

(22) Filed: Mar. 15, 2012

(65) Prior Publication Data

US 2012/0228056 A1 Sep. 13, 2012

Related U.S. Application Data

(63) Continuation of application No. 11/899,686, filed on Sep. 7, 2007, now Pat. No. 8,177,025.

(60) Provisional application No. 60/843,187, filed on Sep. 8, 2006.

(51) Int. Cl.
*A62B 35/04* (2006.01)
*A62B 35/00* (2006.01)

(52) U.S. Cl.
CPC ..... *A62B 35/0037* (2013.01); *A62B 35/0031* (2013.01)
USPC ..... 182/3; 182/4; 24/265 AL

(58) Field of Classification Search
CPC ..... A62B 35/0025; A62B 35/0031; A62B 35/0037; E05D 7/1066; B64D 17/32
USPC ..... 182/3, 4; 16/267–269, 303, 330, 341, 16/344, 415, 416, 419, 420, 446; 24/265 AL
See application file for complete search history.

(56) References Cited

U.S. PATENT DOCUMENTS

| | | | |
|---|---|---|---|
| 908,285 | A | 12/1908 | Lewis |
| 980,193 | A | 1/1911 | Brenia |
| 1,621,076 | A | 3/1927 | Lotz |
| 3,424,134 | A | 1/1969 | Rosenblum |
| 4,253,544 | A | 3/1981 | Dalmaso |
| 5,012,553 | A | 5/1991 | Hardigg et al. |
| 5,697,329 | A | 12/1997 | Bell et al. |

(Continued)

FOREIGN PATENT DOCUMENTS

| | | |
|---|---|---|
| CA | 2 424 466 | 10/2004 |
| WO | WO 2008/030552 | 3/2008 |

OTHER PUBLICATIONS

Written Opinion of the International Searching Authority dated Apr. 21, 2008 (9 pages).

*Primary Examiner* — Alvin Chin Shue
*Assistant Examiner* — Colleen M Chavchavadze
(74) *Attorney, Agent, or Firm* — Wood, Phillips, Katz, Clark & Mortimer

(57) ABSTRACT

A back pad system for use in connection with a safety harness which includes at least two spaced back straps and a connector adapted to be connected to a line or lanyard. In one form, the system includes a back pad having passages through which the two back straps can be passed to be crossed over the connector, an attachment to which the connector can be moveably attached, and at least one member that captures the connector in an upright position upon application of force such as manual force (either directly or indirectly) to the connector to move the connector to the upright position.

18 Claims, 16 Drawing Sheets

(56) References Cited

U.S. PATENT DOCUMENTS

| | | | |
|---|---|---|---|
| 5,774,948 | A | 7/1998 | Petschke et al. |
| 6,006,860 | A | 12/1999 | Bell |
| 6,253,874 | B1 | 7/2001 | Casebolt et al. |
| 7,073,627 | B2 | 7/2006 | Casebolt et al. |
| 7,451,525 | B2 | 11/2008 | Willems |
| 7,520,029 | B2 | 4/2009 | Jonsson |
| 2005/0067222 | A1 | 3/2005 | Casebolt et al. |
| 2005/0082114 | A1 | 4/2005 | Casebolt et al. |
| 2006/0005293 | A1 | 1/2006 | Frey et al. |
| 2006/0102423 | A1 | 5/2006 | Lang et al. |

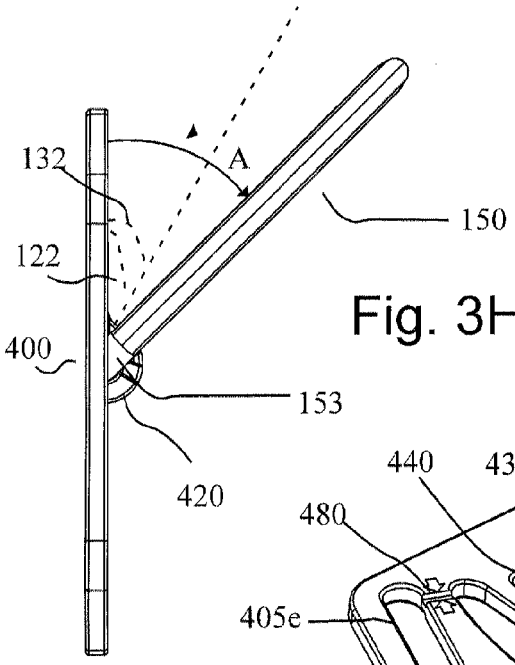
Fig. 3H
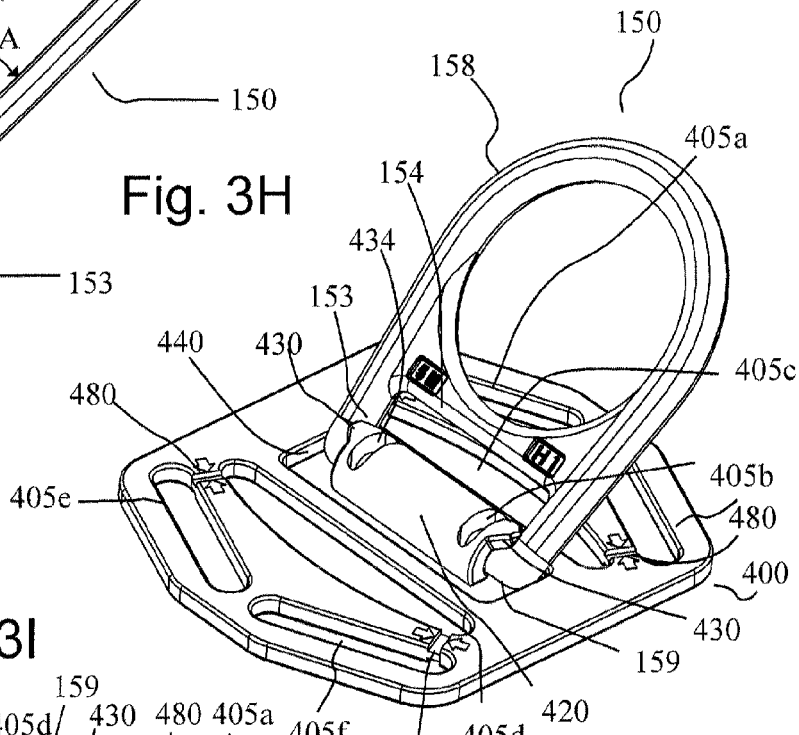
Fig. 3I
Fig. 3J
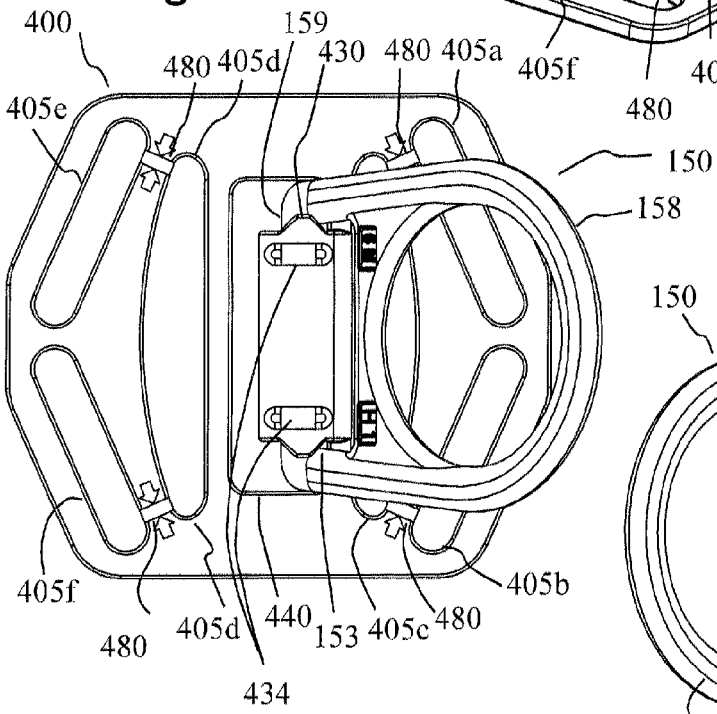
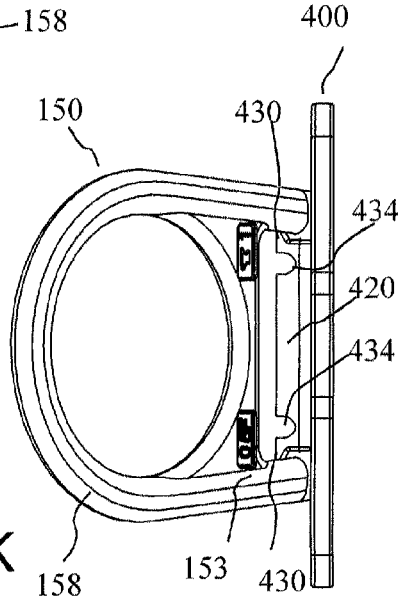
Fig. 3K

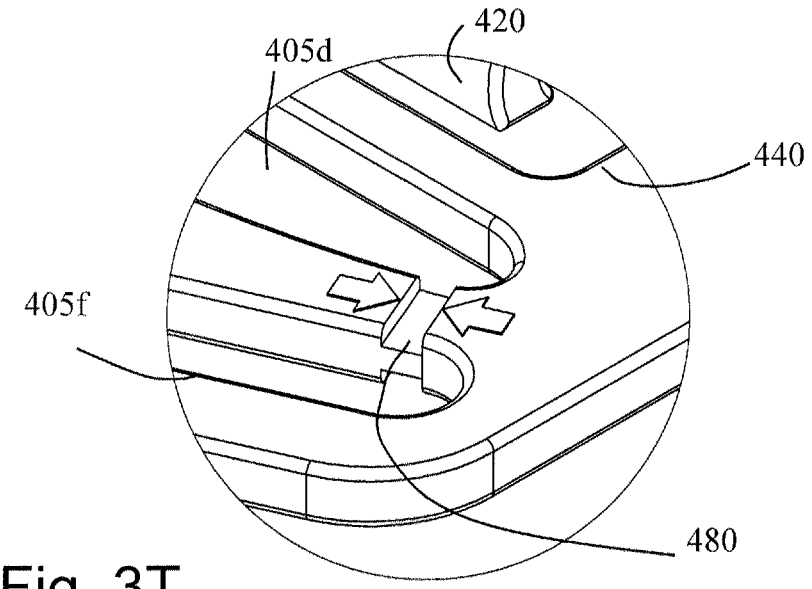
Fig. 3T
DETAIL A
Figure 3Q
SCALE 2 : 1
Fig. 3U
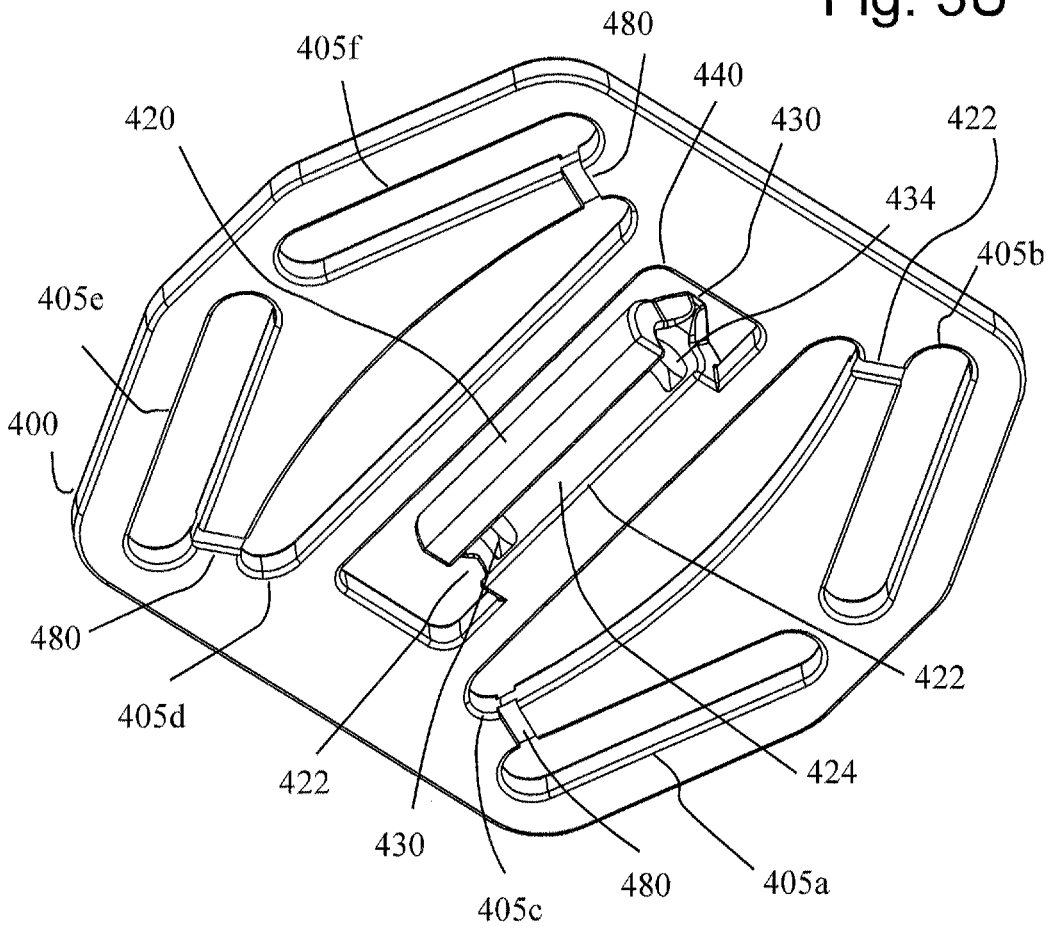

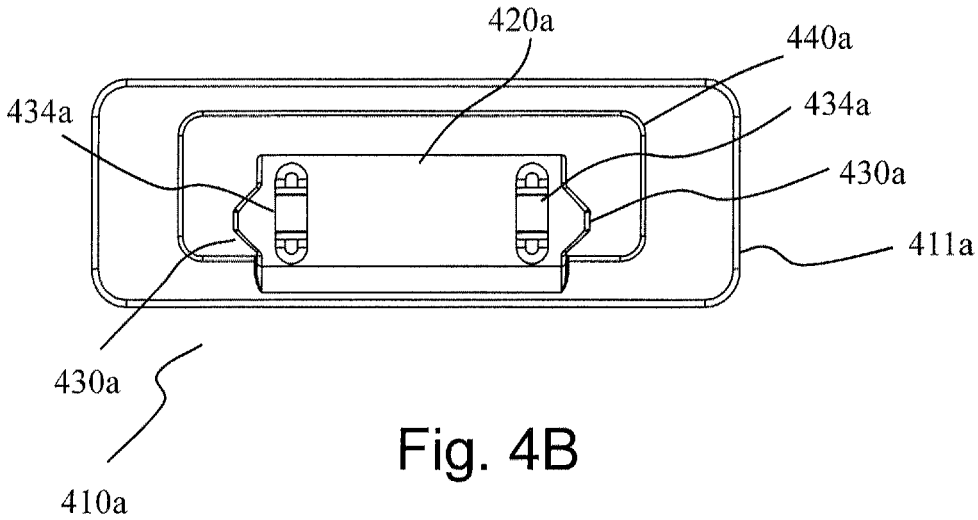
Fig. 4B
Fig. 4A
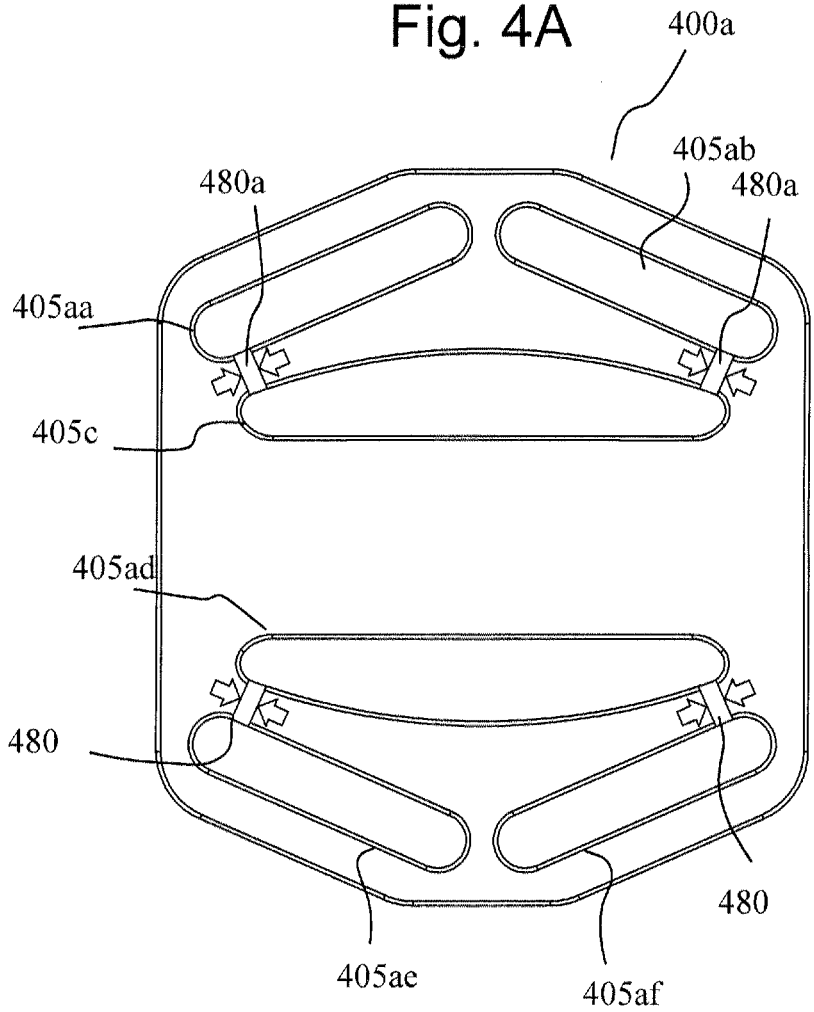

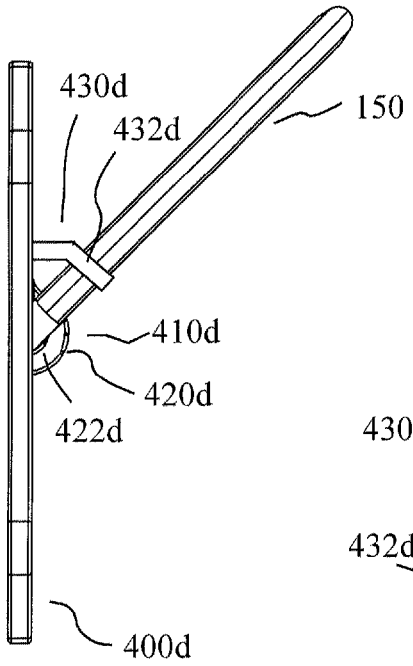
Fig. 6A
Fig. 6C
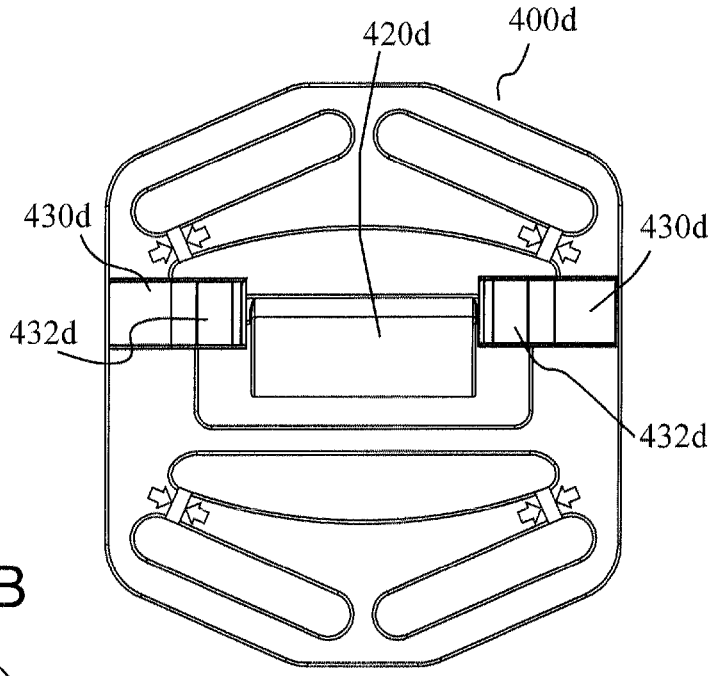
Fig. 6B
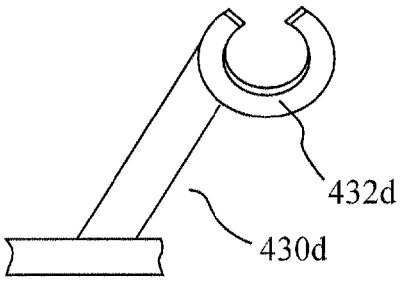
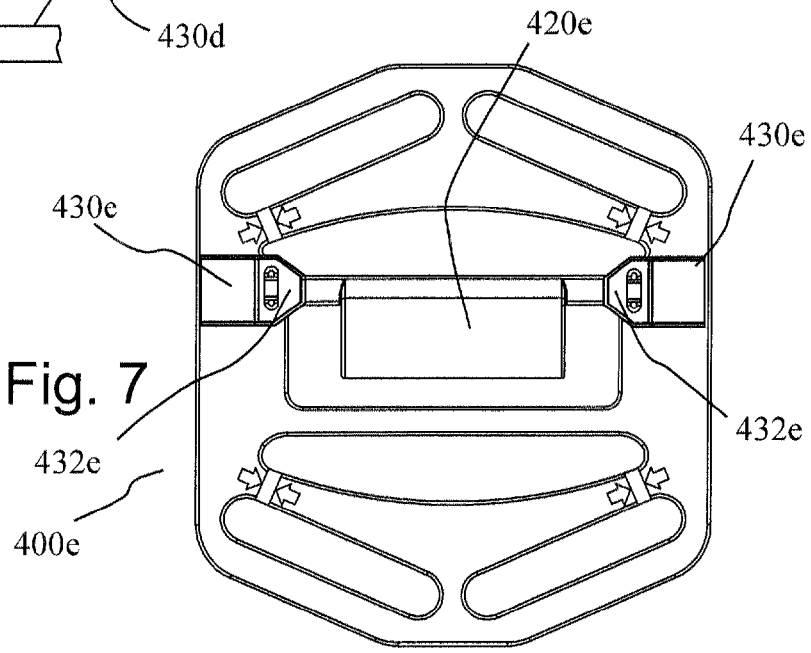
Fig. 7

SAFETY HARNESSES, CONNECTIVE RING ATTACHMENTS FOR USE IN SAFETY HARNESSES AND BACK PADS FOR USE IN SAFETY HARNESSES

CROSS-REFERENCE TO RELATED APPLICATIONS

This application is a continuation of U.S. Ser. No. 11/899,686, filed Sep. 7, 2007 and U.S. Ser. No. 60/843,187, filed Sep. 8, 2006, the disclosures of which are hereby incorporated by reference.

FEDERALLY SPONSORED RESEARCH OR DEVELOPMENT

Not Applicable.

MICROFICHE/COPYRIGHT REFERENCE

Not Applicable.

BACKGROUND

The present invention relates generally to safety harnesses, and particularly to full body safety harnesses which, for example, provide ease of attachment of, for example, a safety lanyard or self retracting lanyard to a D ring or other connective ring attached to the safety harness and/or provide a readily detectable indication that the safety harness has been subjected to a significant force (for example, as in an impact or in a fall).

The following information is provided to assist the reader in understanding the invention disclosed below and the environment in which it will typically be used. The terms used herein are not intended to be limited to any particular narrow interpretation unless clearly stated otherwise in this document. References set forth herein may facilitate understanding of the present invention or the background of the present invention. The disclosure of all references cited herein are incorporated by reference.

Safety harnesses are commonly used as part of a fall protection system for persons subjected to the potential of a fall from a height. In the workplace, full-body safety harnesses are required when working at a height of six feet or greater. Such harnesses, which typically include both an upper torso portion (having, for example, shoulder straps) and a lower torso or seat portion (having, for example one or more leg straps and sometimes a seat strap), can be designed in many alternative manners.

FIG. 1 illustrates an embodiment of a conventional, commercially available full-body safety harness 10 Safety harness 10 includes an upper torso portion 12 comprising first and second shoulder straps 20 and 30, respectively, for extending over the shoulders of the user and a multi-component chest strap 40 for extending over a portion of the chest of the user.

A first end of each of shoulder straps 20 and 30 extends down over the back of the user to form first and second generally longitudinal back straps 22 and 32, respectively. Longitudinal back straps 22 and 32 of shoulder straps 20 and 30 cross through and connect to a typical connector such as a D-ring 50 as known in the art. D ring 50 includes a harness connection portion 52 and an anchor portion 54. Harness connection portion 52 enables fastening of D-ring 50 to safety harness 10 via longitudinal back straps 22 and 32. Anchor portion 54 is adapted to be connected to a nylon rope, a chain, webbing or other connector which may be used to anchor the person wearing safety harness 10. Safety harness 10 includes a rear pad or back pad 56 that functions to guide the rear strap portions of the shoulder straps in a crossing fashion over the back of the user in the vicinity of D ring 50.

After crossing and passing through D-ring 50, shoulder straps 20 and 30 are connected via a generally latitudinal back strap 60. Latitudinal back strap 60 passes generally latitudinally over a portion of the back of the user.

A second end of each of shoulder straps 20 and 30 extends downward over the front of the user to from generally longitudinal first and second front straps 24 and 34, respectively. A first chest strap portion 42 is attached to front strap 24 and a second chest strap portion 44 is attached to front strap 34. Each of first and second chest straps 42 and 44 have cooperating fastening members 46 and 48 on the ends thereof to enable attachment of first and second chest straps 42 and 44 to form chest strap 40. As known in the art, first and second chest straps 42 and 44, respectively, are preferably attached via an adjustable mating friction buckle mechanism, including, for example, cooperating fastening members 46 and 48.

First and second front straps 24 and 34 of shoulder straps 20 and 30, respectively, extend further downward and preferably include adjustment members 26 and 36 (for example, adjustable friction buckles) as known in the art for adjustment of the fit of safety harness 10 on the upper torso of the user. Extending still further downward, extensions 24*a* and 34*a* of first and second front straps 24 and 34 converge and, in connection with several other components of safety harness 10 as described below, form a lower torso, seat or subpelvic portion 70. First and second front extension straps 24*a* and 34*a* connect at section 98, passing to the rear and under the seat of the user.

Attached to and extending from seat portion 70 are a first and a second leg strap 80 and 90, respectively. Each of first and second leg straps 80 and 90 pass around the upper leg of the user to be attached to the distal end of first and second longitudinal back straps 22 and 32, respectively. The distal ends of each of first and second leg straps 80 and 90 and the distal ends of each of longitudinal back straps 22 and 32 thus preferably comprise cooperating fastening members (82 and 92 and 28 and 38, respectively) such as adjusting buckle members as known in the art.

As in most commercially available harnesses, anchor portion 54 of D ring 50 hangs downward as a result of the force of gravity after a harness is donned by the user. This position of D ring 50 causes a significant amount of difficulty in attaching, for example, a snap hook (not shown) on the end of a lanyard (not shown) to D ring 50 once harness 10 has been donned. Indeed, the wearer of a safety harness such as safety harness 10 often has to have another person connect such a snap hook (or other lanyard connector) to D ring 50.

U.S. Pat. No. 7,073,627 and Published U.S. Patent Application No. US2005/0082114 disclose a spring-loaded mechanism that constantly biases or urges a D ring to an upright (or standup) position to facilitate attachment of a snap hook or other connector to the D ring. The spring-loaded mechanism of U.S. Pat. No. 7,073,627 and Published U.S. Patent Application No. US2005/0082114 can be somewhat costly to manufacture. Moreover, moving parts such as spring can sometime become disconnected with the remainder of the assembly or fail during use.

It is often desirable that a safety harness also be provided with a means of providing an indication that the safety harness has been subjected to a significant force or impact (such as occurs during an impact or a fall). In that regard, a safety harness or a lanyard that has been subjected to such a force should be taken out of service. U.S. Pat. No. 4,253,544, for example, discloses a lanyard in which stress of a fall causes breakage of stitching and the release of a flag as an indicator. U.S. Pat. No. 6,006,860 discloses a safety harness in which visible rupture of stands of fabric in a harness webbing provides an indication of a fall.

U.S. Pat. No. 7,073,627 and Published U.S. Patent Application No. US2005/0082114 disclose a dorsal pad assembly that includes a D ring connector portion in which the D ring is urged to an upright position as described above. The dorsal pad assembly of U.S. Pat. No. 7,073,627 and Published U.S. Patent Application No. US2005/0082114 can also include an impact indicator in the form of a clip to which D ring is operatively connected. In the case of a fall, the D ring snaps out of the D ring clip/indicator by deflecting catches built into the D ring clip/indicator, thereby indicating that a force has been applied to the D ring. A bar portion of the D-ring can also include a colored portion or an ink cartridge that is broken that becomes exposed when the D-ring snaps out of the clip. Alternate embodiments of the dorsal pad assembly of U.S. Pat. No. 7,073,627 and Published U.S. Patent Application No. US2005/0082114 disclose impact indicators in the form of a wear pad and/or wear pad frame, or a D-ring bar engaging device, operatively connected to the D-ring. In the case of a fall, the D-ring is moved relative to the wear pad and/or wear pad frame, or the bar engaging device, thus breaking rivets, breaking an ink cartridge, exposing a colored portion of the D-ring or deflecting tabs, thereby indicating a force has been applied to the D-ring. U.S. Pat. No. 7,073,627 and Published Patent No. US2005/0082114 disclose a further alternate embodiment of an impact indicator in the form of a clip that holds the D-ring in a certain position wherein the D-ring is pulled out of the clip in the case of a fall, thereby indicating that a force has been applied to the D-ring.

It is also well known that all portions of the safety harness should be inspected for signs of an impact or fall. It is, for example, well know that back pads used in connection with safety harnesses can distend or otherwise change in appearance and sometimes break in the case of a fall. For example, the User Instructions provided with the Full Body Tiger Harness available from Rose Manufacturing Company, indicate that the D-ring locater pad or back pad should be inspected for a change in appearance (for example, breakage) providing evidence of a fall.

Although a number of fall and/or impact indicators have been provided in a number of harnesses, such indicators can increase the manufacturing time and cost involved in assembly of the harness. This problem is particularly relevant to indicators that include or are part of assemblies of multiple elements. Moreover, such multi-element assemblies can sometimes fail.

It is very desirable to develop improved safety harnesses and elements or components thereof that reduce or eliminate the above and other problems with currently available harnesses.

SUMMARY

In one aspect, the present invention provides a back pad system for use in connection with a safety harness. The safety harness includes at least two spaced back straps and a connector adapted to be connected to a line or lanyard. The back pad system includes a back pad including passages (for example, at least two passages) through which the two back straps can be passed to be crossed over the connector. The back pad system also includes an attachment to which the connector can be moveably attached. The back pad system further includes at least one member that captures, maintains or holds the connector in an upright position upon application of force (either directly or indirectly—for example, manual force) to the connector to move the connector to the upright position.

The connector attachment can include a seating adapted to seat the connector so that the connector is rotatable relative to the connector attachment to the upright position. The at least one capture member can, for example, be attached to a side of the back pad. The at least one capture member can also, for example, include a detent on a lateral side of the connector attachment that is adapted to capture the connector in the upright position. In one embodiment, the connector attachment includes a first detent on a first lateral side of the connector attachment and a second detent on a second lateral side of the connector attachment. The first detent and the second detent are adapted to capture the connector in the upright position. The connector can, for example, be a D ring comprising a bottom bar that fits within the seating of the connector attachment.

The back pad can further include at least one load indicator including an area of reduced strength in the back pad so that the area visibly distends or breaks upon the safety harness being subjected to a substantial load. As clear to one skilled in the art, the load can readily be predetermined. The substantial load can, for example, be at least approximately 450 pounds of force.

In several embodiments back pad systems of the present invention, the connector attachment and the capture member(s) are attached to the back pad. The back pad, the connector attachment and the capture member(s) can, for example, be formed monolithically. In one such embodiment, the at least one capture member includes a detent on a lateral side of the connector attachment that is adapted to capture the connector in the upright position. In another such embodiment, the connector attachment includes a first detent on a first lateral side of the connector attachment and a second detent on a second lateral side of the connector attachment. The first detent and the second detent are adapted to capture the connector in the upright position.

The connector attachment and/or capture members can also be formed separately from the back pad and not be attached to the back pad.

In another aspect, the present invention provides a connector attachment for use in connection with a safety harness including at least two spaced back straps and a connector adapted to be connected to a line or lanyard. The connector attachment includes at least one member that captures the connector in an upright position upon application of force (either directly or indirectly) to the connector to move the connector to the upright position and a seating adapted to seat the connector so that the connector is rotatable relative to the connector attachment to the upright position.

The connector attachment can, for example, include a first detent on a first lateral side of the connector attachment and a second detent on a second lateral side of the connector attachment. The first detent and the second detent are adapted to capture the connector in the upright position. The connector can, for example, be a D ring including a bottom bar that fits within the seating of the connector attachment.

In another aspect, the present invention provides a back pad for use in connection with a safety harness including at least two spaced back straps and a connector adapted to be connected to a line or lanyard. The back pad includes a base comprising passages through which the two back straps can be passed to be crossed over the connector. The back pad further includes at least one load indicator. The load indicator includes an area of reduced strength in the base so that the area visibly distends or breaks upon the safety harness being subjected to a substantial load. The substantial load can, for example, be predetermined to be at least approximately 450 pounds of force. The area of reduced strength can, for example, be an area of reduced thickness. The back pad can, for example, include a plurality of areas of reduced thickness.

In one embodiment, the pack pad includes a first upper slot, a second upper slot, a central upper slot, a central lower slot, a first lower slot and a second lower slot. The back pad can also include a first area of reduced thickness between the first upper slot and the central upper slot, a second area of reduced thickness between the second upper slot and the central upper slot, a third area of reduced thickness between the first lower slot and the central lower slot and a fourth area of reduce thickness between the second lower slot and the central lower slot.

In another aspect, the present invention provides a safety harness including a connector adapted to be connected to a line or lanyard, an attachment to which the connector can be moveably attached, and at least one member that captures the connector in an upright position upon application of force (either directly or indirectly) to the connector to move the connector to the upright position.

In a further aspect, the present invention provides a safety harness including at least two spaced back straps, a connector adapted to be connected to a line or lanyard. The safety harness further includes a back pad system including a back pad including passages (for example, at least two passages) through which the two back straps can be passed to be crossed over the connector, an attachment to which the connector can be moveably attached, and at least one member that captures the connector in an upright position upon application of manual force (either directly or indirectly) to the connector to move the connector to the upright position.

In another aspect, the present invention provides a safety harness including at least two spaced back straps and a connector adapted to be connected to a line or lanyard. The safety harness further includes a back pad including a base including passages through which the two back straps can be passed to be crossed over the connector and at least one load indicator. The load indicator includes an area of reduced strength in the base so that the area visibly distends or breaks upon the safety harness being subjected for a substantial load. The area of reduced strength (as compared to other portions of or the remainder of the back pad) is purposefully created (for example, during manufacture of the back pad).

In still a further aspect, the present invention provides a load indicator for use in connection with a safety harness comprising at least two spaced straps. The load indicator provides a visible indication that the safety harness has been subjected to a substantial load. The load indicator includes at least a first connector and a second connector in connection with the first connector. The first connector is adapted to connect to the first strap and the second connector is adapted to connect to the second strap. A change in force exerted on the load indicator by the first strap and the second strap when the safety harness is subjected to the substantial load causes the load indicator to change in appearance.

The first connector can, for example, include at least a one passage through which the first strap passes, and the second connector can include at least one passage through with the second strap passes. The change in appearance of the load indicator can, for example, be a distention or breaking of at least a portion of the load indicator. The change in force exerted on the load indicator can, for example, at least in part, be caused by relative movement between the load indicator and the first and second straps. In several embodiments, the load indicator is adapted to be positioned in proximity to an area where the first strap and the second strap cross (for example, adjacent to or spaced from a back pad through which the straps cross). The load indicator can, for example, form a back pad through which the first strap and the second strap are crossed.

The present invention, along with the attributes and attendant advantages thereof, will best be appreciated and understood in view of the following detailed description taken in conjunction with the accompanying drawings.

BRIEF DESCRIPTION OF THE DRAWINGS

FIG. 3H illustrates a side view of the back pad of FIG. 3A wherein the D ring is in an upright position.

FIG. 3I illustrates a rearward view of the back pad of FIG. 3A wherein the D ring is in an upright position.

FIG. 3J illustrates another rearward perspective view of the back pad of FIG. 3A wherein the D ring is in an upright position.

FIG. 3K illustrates a top view of the back pad of FIG. 3A wherein the D ring is in an upright position.

FIG. 3T illustrates another enlarged, rearward perspective view of a portion of the back pad of FIG. 3A (encircled in FIG. 3Q) illustrating an area of decreased thickness in the back pad to create a stress point to provide a visual indication in the case that the safety harness in connection with which the back pad is used is subjected to a relatively large force or load as would occur in an impact or a fall.

FIG. 3U illustrates another rearward perspective side view of the back pad of FIG. 3A wherein the D ring has been removed from connection with the D ring attachment of the back pad.

FIG. 4A illustrates a rearward view of a hexagonal back pad providing an embodiment of a load indicator of the present invention.

FIG. 4B illustrates a rearward view of a D-ring attachment of the present invention that can be use in connection with the back bad of FIG. 4A.

FIG. 6A illustrates a side view another embodiment a back pad of the present invention including capture members to hold a D ring in an upright position.

FIG. 6B illustrates an enlarged bottom view of one of the capture members of the back pad of FIG. 6A.

FIG. 6C illustrates a rearward view of the back pad of FIG. 6A with the D ring removed from connection therewith.

FIG. 7 illustrate a rearward view of another embodiment of a back pad of the present invention including a capture member having flexing detents to hold a D ring in an upright position in which the D ring is removed from connection with the back pad.

DETAILED DESCRIPTION

Figure 1:
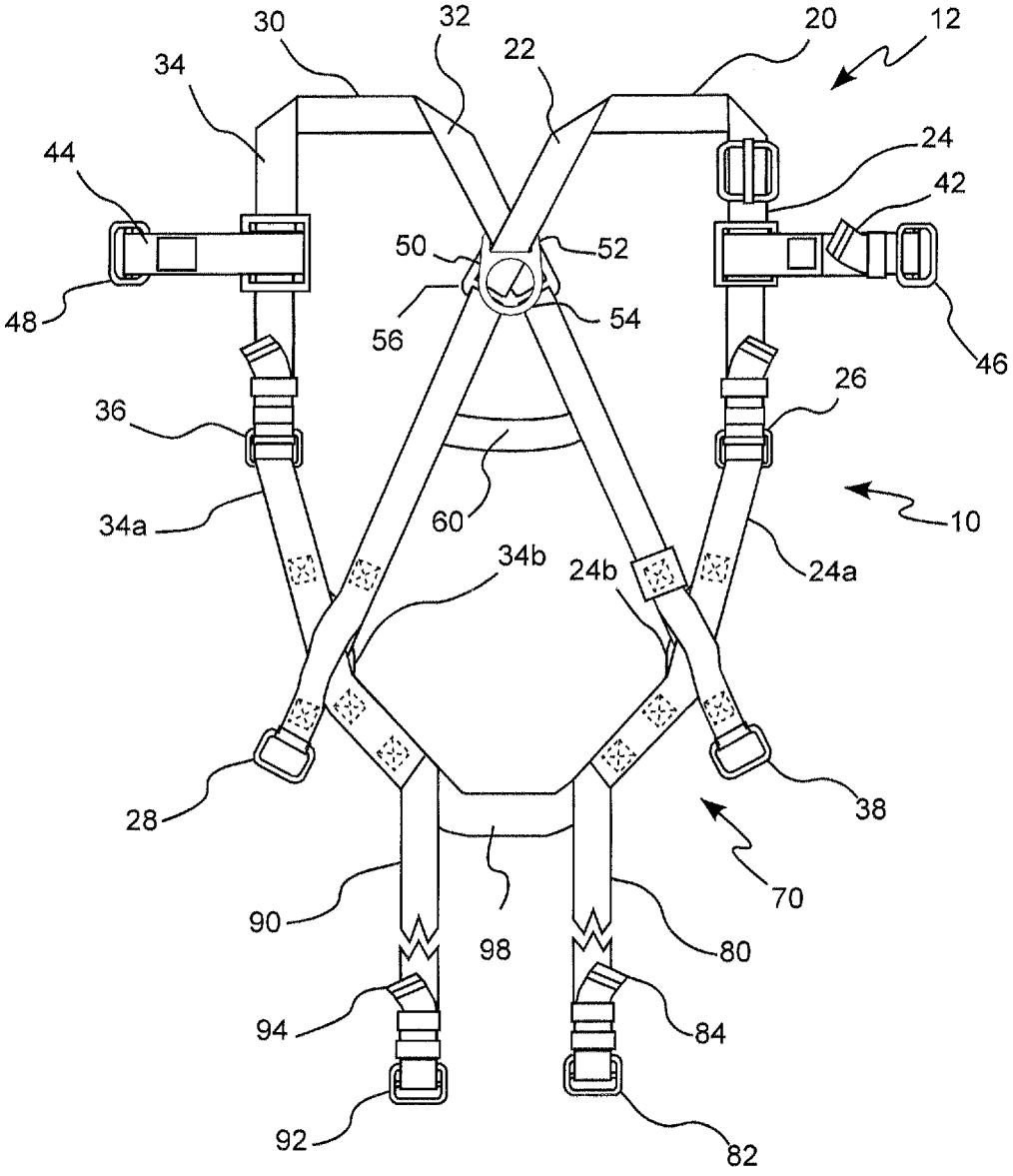
Fig. 1 (Prior Art)
FIG. 1 illustrates an embodiment of a commercially available safety harness.
Figure 2A:
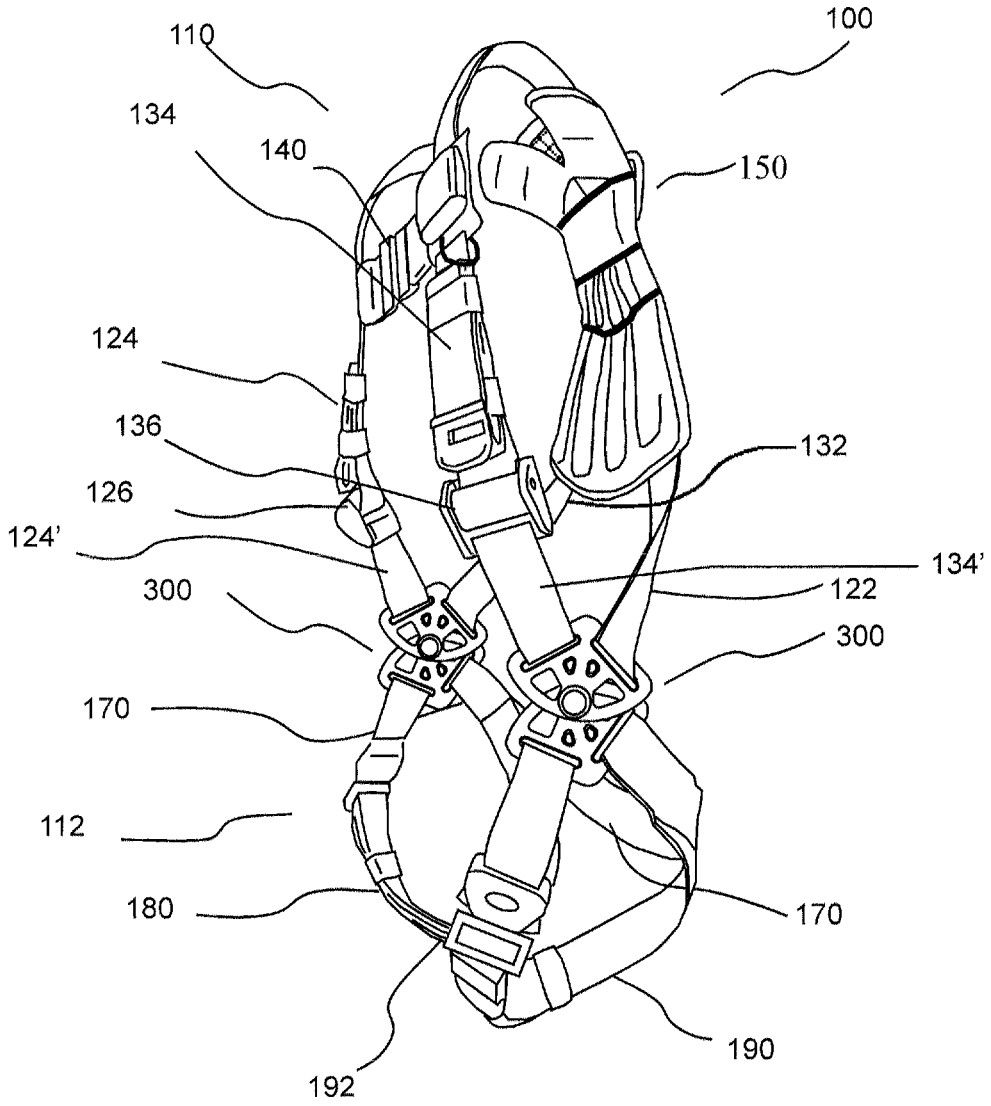
FIG. 2A illustrates a perspective view of an embodiment of a harness of the present invention in a form as donned by a user.
Figure 2B:
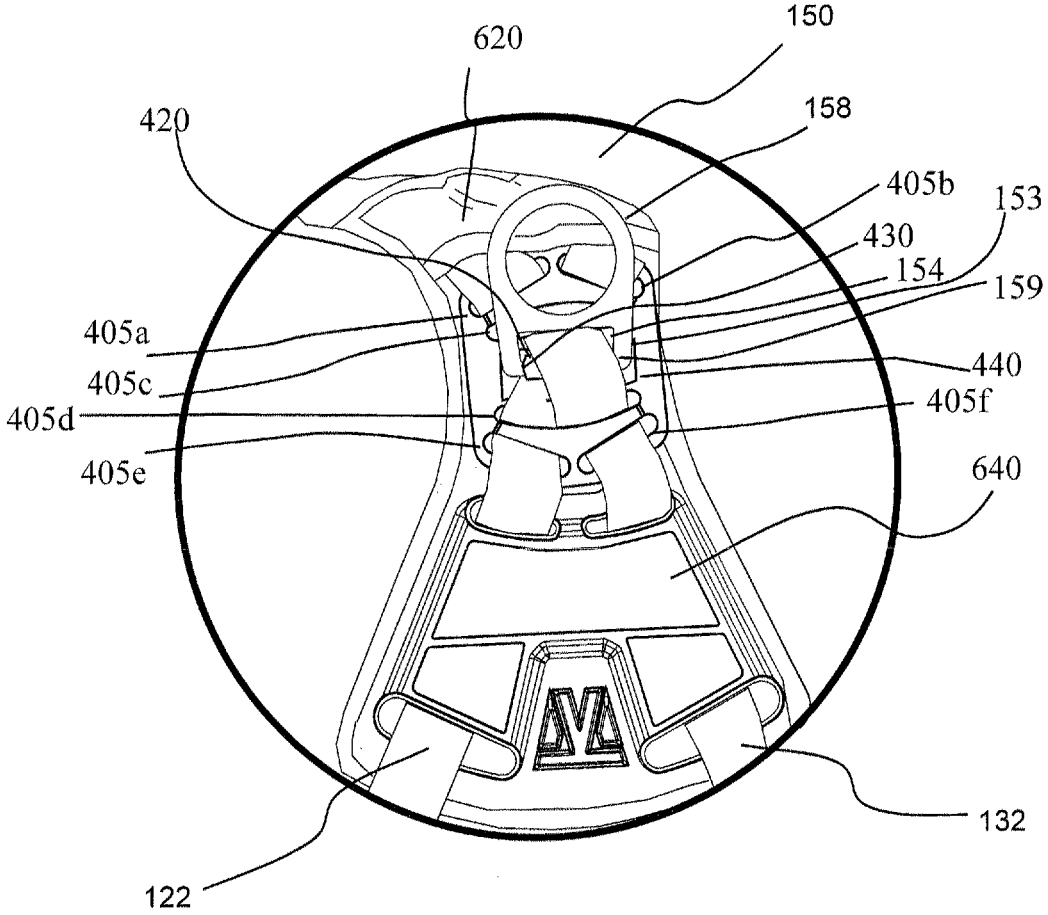
FIG. 2B illustrates a perspective view of a portion of the safety harness of FIG. 2A including a back pad of the present invention.

FIGS. 2A and 2B illustrate one embodiment of a full body safety harness 100 of the present invention. Various general aspects of safety harness 100 are disclosed in Published U.S. Patent Application Nos. 2006/0005293 and 2006/0102423, assigned to the assignee of the present invention. Safety harness 100 includes an upper torso section, portion or module 110 and a lower torso or seat section, portion or module 112. Upper torso portion 110 includes a first shoulder strap 120 and a second shoulder strap 130 extending over the shoulders of the user and a multi-component chest strap 140 extending between first shoulder strap 120 and second shoulder strap 130. First ends of each of shoulder straps 120 and 130 extend down over the back of the user to form first and second generally longitudinal back straps 122 and 132, respectively. Back straps 122 and 132 cross through an opening 153 in D ring 150 and thereby are connected to D ring 150. In the area of D ring, back straps 122 and 132 also cross through a back pad 200 (see FIG. 2B) in the region of D ring 150. Back pad 200 is described further below. Back straps 122 and 132 are attached at their respective ends to right side and left side connectors 300, that operate to connect upper torso portion or module 110 to lower seat portion or module 112 such that upper torso portion 110 is relatively easily rotated relative to lower seat portion 112. Back straps 122 and 132 can, for example, be looped around slots formed in connectors 1900 and stitched.

As used herein terms such as "left", "right", "side", "front", "back", "up", "down", "reward", "forward", "top", "bottom" and similar terms when used to refer to harness 100 or any portion thereof (including a back pad or back pad system 400 as described below) refer to a direction relative to the orientation of harness 100 (or a portion thereof) when harness 100 is donned or worn by a user as illustrated in FIG. 2A. Such designations are provided for ease of reference and are not to be construed as limiting the present invention to any particular embodiment unless specifically set forth otherwise.

A second end of each of shoulder straps 120 and 130 extends downward over the front of the user to form generally longitudinal first and second front straps 124 and 134, respectively. Chest strap 140 is attached between front strap 124 and front strap 134 of shoulder straps 120 and 130, respectively. One or more adjustable adjustment mechanism can be provided to adjust the length of chest strap 140.

First and second front straps 124 and 134 extend further downward from chest strap 140 and terminate at and are attached to a cam buckle adjustment mechanisms 126 and 136, respectively, or other adjustment mechanism for adjustment of the fit of safety harness 100 on the upper torso of the user. Lengths of connecting strapping strap 124' and 134' are connected at a first end thereof to cam buckles 100 and at a second end thereof to connectors 300. In that regard, straps 124' and 134' can, for example, be looped through slots formed in connectors 300.

Lower torso or seat portion 112 of safety harness 100 can, for example, include leg straps 180 and 190. Leg strap 180 can be attached to right side connector 300 at a first or front end thereof via a slot formed therein. A second or rearward end of leg strap 180 is attached to seat strap 170. Seat strap 170 is attached at a first end thereof to right side connector 300 via a slot formed therein. Similarly, leg strap 190 is attached to left side connector 300 at a first or front end thereof via a slot formed therein. A second or rearward end of leg strap 190 is attached to seat strap 170. A second end of seat strap 170 is attached to left side connector 300 via a slot formed therein. Leg straps 180*a* and 190*a* can include adjustment members or mechanisms.

As illustrated in FIG. 2B, D-ring 150 and back pad or back pad system 400 are positioned over an intermediate section of comfort pad 600 between a meshed section 620 and shield section 640 of comfort pad 600, which are described in detail, for example, in Published U.S. Patent Application No. 2006/

Figure 2C:
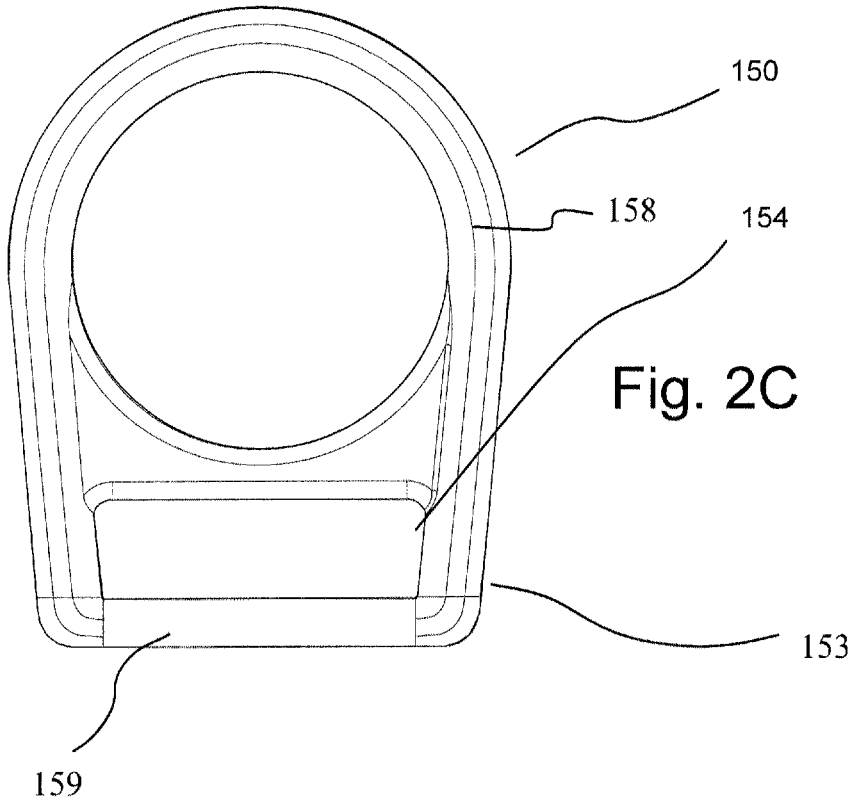
FIG. 2C illustrates a rearward view of an embodiment of a D-ring for use in connection with the harness of FIG. 2A.

0102423, the disclosure of which is incorporated herein by reference. In the illustrated embodiment, back pad 400 is not attached to comfort pad 600. As known in the art, back pad 400 includes six slots 405*a-f* through which straps 122 and 132 cross and pass through a channel 154 (see FIGS. 2B through 2D) of D ring 150. In the illustrated embodiment, there is a first or left upper slot 405*a*, a second or right upper slot 405*b*, and generally central upper slot 405*c*, a generally central lower slot 405*d*, a first or left lower slot 405*d* and a second or right lower slot 405*e*. A connector such as a snap hook (not shown) can be connected to anchor attachment portion 158 of D-ring 150.

Figure 3A:
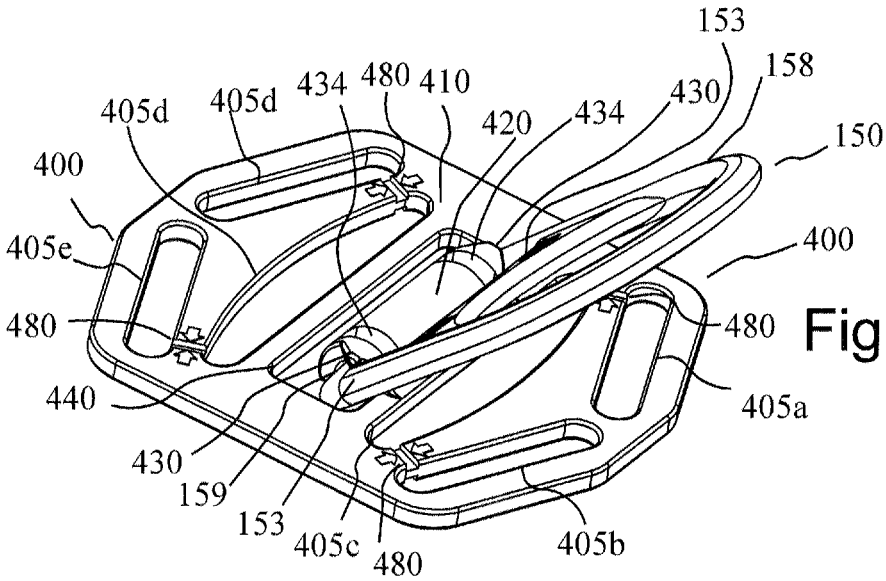
FIG. 3A illustrates a rearward perspective view an embodiment of a back pad of the present invention for use in connection with the harness of FIG. 2A wherein the D ring is captured in an upright position.

As illustrated, for example, in FIGS. 3A through 3U, back pad 400 can include a D ring attachment 410 in which D ring 150 is movably (for example, rotatably or pivotably) seated or attached. Upon application of direct or indirect force (for example, manual force) to D ring 150 to move D ring 150 to an upright position, D ring 150 is captured, held or maintained in the upright position. Neither attachment 410 nor any other element of back pad 400 urges or biases D ring 150 into an upright position. However, D ring 150 is captured, held or maintained in an upright position when D ring is moved to that position via application of force thereto. Extra components associated with a biasing or urging mechanism (for example, springs) are thereby eliminated.

In the illustrated embodiment, D ring attachment 410 includes a generally cylindrical central portion 420 including a generally cylindrical passage 422 therethrough in which a lower bar or connecting member 159 of D ring 150 is positioned or seated. In that regard, during attachment of D ring 150 to attachment 410, bar 159 is first passed through an opening 440 formed in back pad 400. Bar 159 is then aligned with an extending opening or slot 424 formed on a forward side (with respect to the orientation of back pad 400 when worn by a user) of central portion 410. Slot 424 is in operative connection with passage 422 and extends along the entire length of central portion 420. Once bar 159 is aligned with slot 424, a rearward force (with respect to the orientation of back pad 400 when worn by a user) is applied to D ring 150 so that bar 159 is snapped into place within passage 422.

Figure 3B:
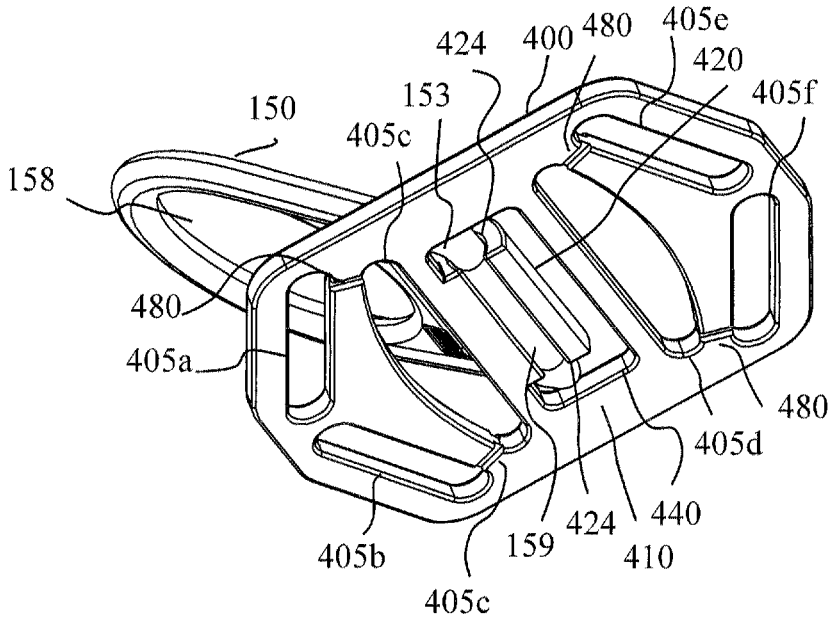
FIG. 3B illustrates a forward perspective view the back pad of FIG. 3A wherein the D ring is captured in an upright position.
Figure 3C:
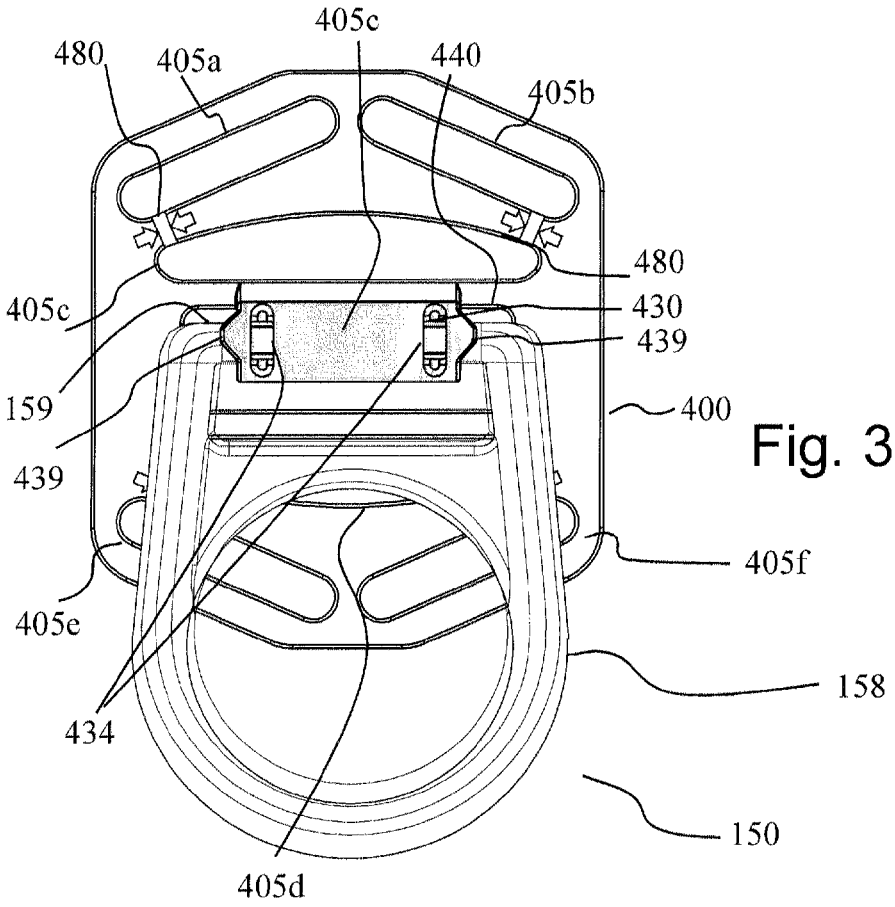
FIG. 3C illustrates a rearward view the back pad of FIG. 3A wherein the D ring is captured in a non-upright or downward position.
Figure 3D:
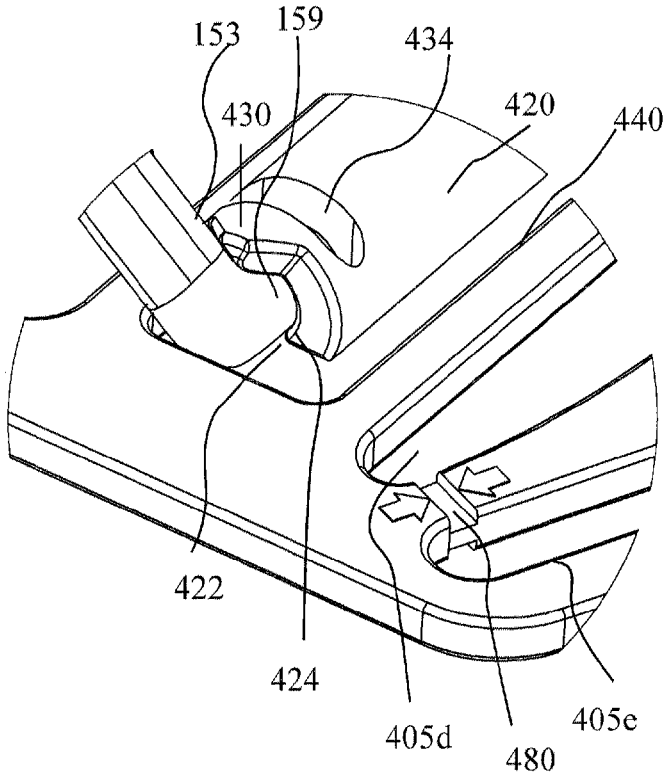
FIG. 3D illustrates a rearward, enlarged perspective view of a portion of the back pad of FIG. 3A wherein the D ring is captured in an upright position.
Figure 3E:
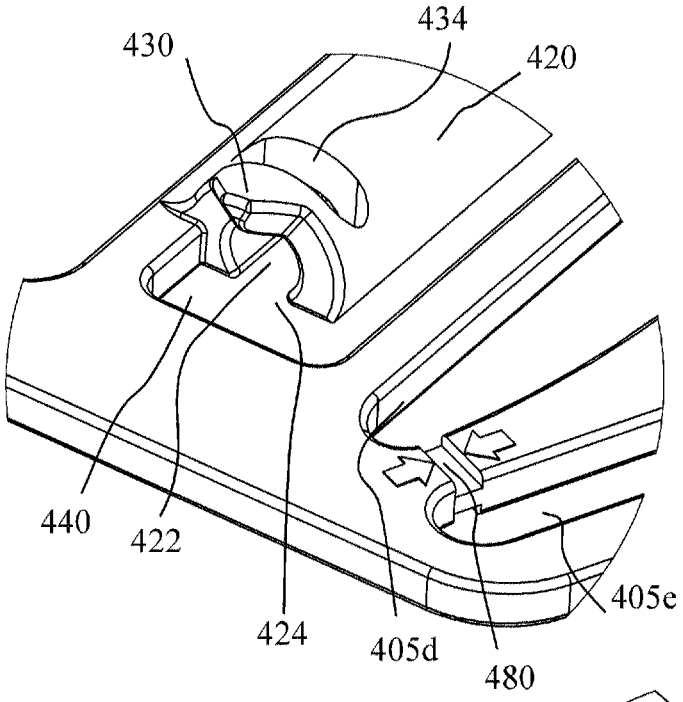
FIG. 3E illustrates the rearward, enlarged perspective view of FIG. 3D wherein the D ring has been removed from connection with the D ring attachment of the back pad.
Figure 3F:
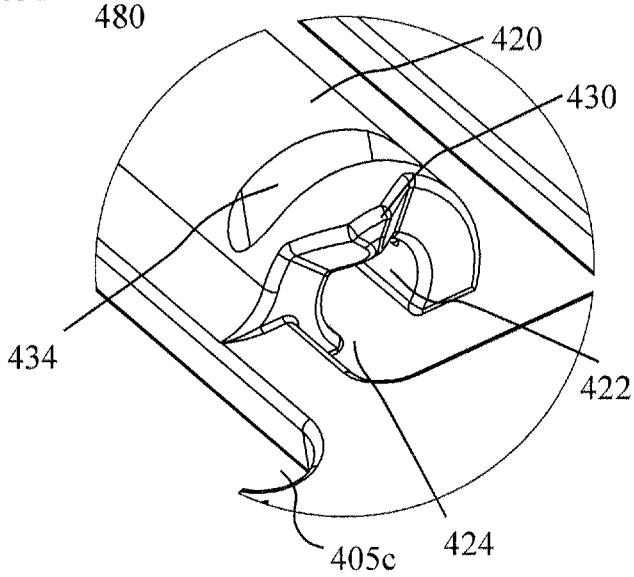
FIG. 3F illustrates another rearward, enlarged perspective view of the back pad of FIG. 3A wherein the D ring has been removed from connection with the D ring attachment of the back pad.
Figure 3G:
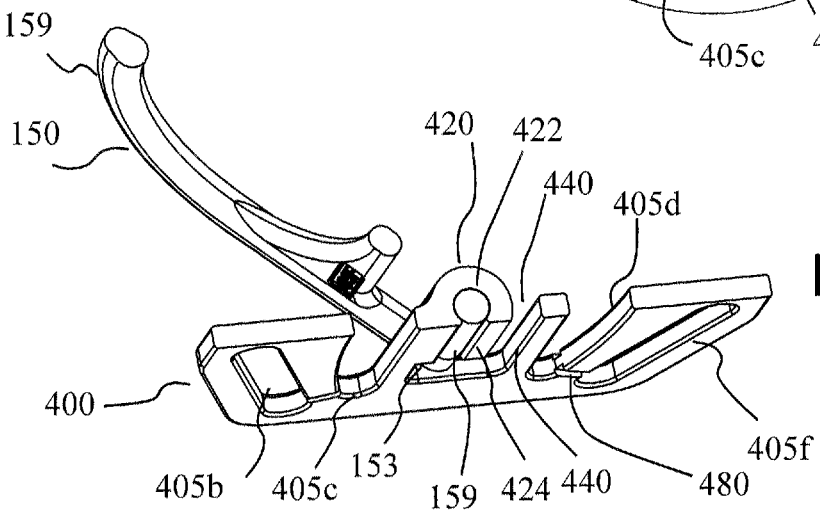
FIG. 3G illustrates a perspective cutaway view of the back pad of FIG. 3A wherein the D ring is in an upright position.
Figure 3L:
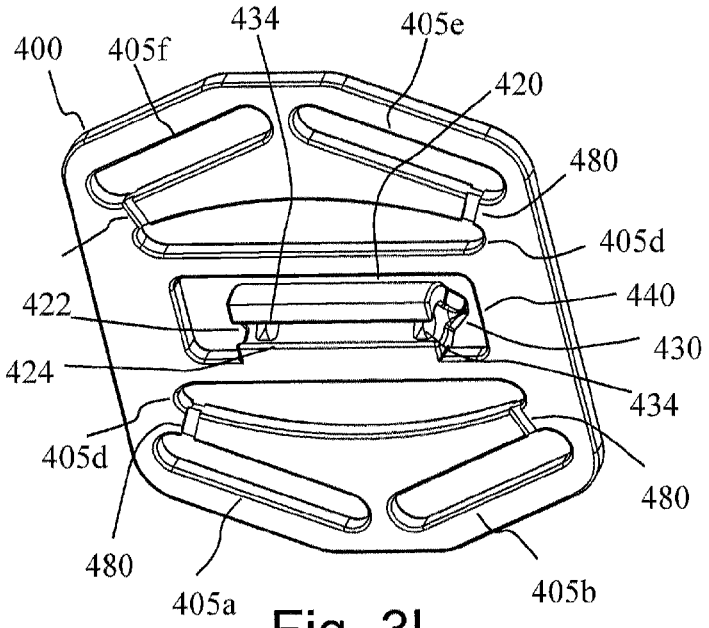
FIG. 3L illustrates another forward perspective view of the back pad of FIG. 3A wherein the D ring has been removed from connection with the D ring attachment of the back pad.

Bar 159 can be rotated within passage 422. D ring 150 is illustrated in a downward position in FIG. 3C. When force is applied to D ring 150 to move D ring toward and upright position (illustrated, for example, in FIGS. 3A and 3B), bar 159 rotates within passage 422. A central wall of side members 153 of D ring 150 contact one or more capture members, abutment members, extensions or detents 430 positioned, for example, on the lateral sides of central portion 420. Detents 430 are forced laterally inward upon contact with side members 153. Openings or expansion slots 434 can, for example, be provided in central portion 420 to facilitate the inward flexing of detents 430. Once side members 153 pass detents 430 (that is, once D ring 150 is moved into the upright position), detents 430 flex laterally outward to capture D ring 150 in the upright position.

Figure 2D:
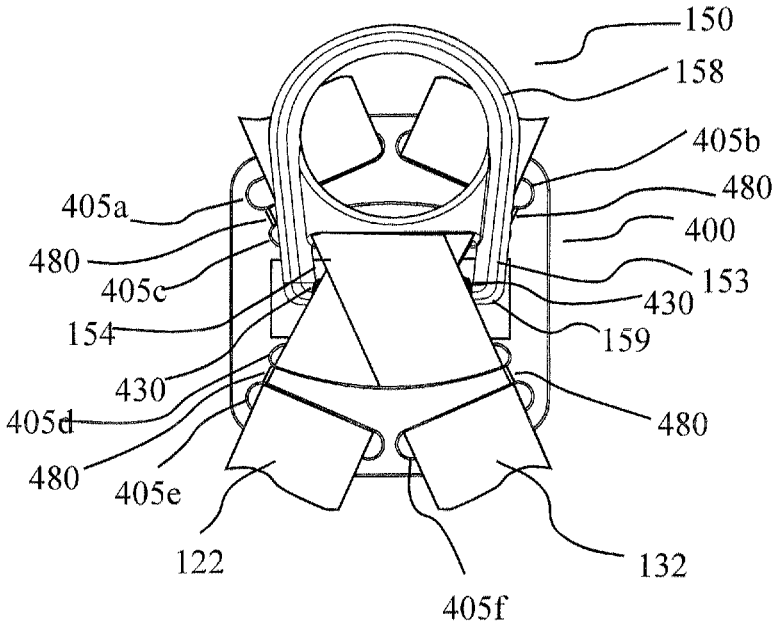
FIG. 2D illustrates a rear view of the back pad portion of the harness of FIG. 2A.

Straps 122 and 132 pass over central portion 420 of D ring attachment 410 (and thereby through channel 154 of D ring 150) as illustrated, for example, in FIGS. 2B and 2D. In general, D ring 150 abuts the rearward or outermost strap (see, for example, FIG. 3H) of harness 100 after D Ring is forced into the upright position such that D ring is maintained within a range of angles (A) of the upright position (for example, between approximately 20° and approximately 45° with respect to a vertical orientation.

Entire back pad/back pad system 400 can, for example, be molded (for example, injection molded) monolithically from a polymeric material such as a thermoplastic polymeric material or a thermoplastic elastomer polymer/thermoplastic polymer blend (for example, a thermoplastic elastomer/polypropylene blend). Other suitable materials include flexible, semi-rigid polymeric materials such as various plastics, rubbers and polyurethanes. There are no components to assemble during manufacture or become disassembled during use. Moreover, there are no moving elements of back pad 400 to fail during use. A user can, for example, push D ring 150 into the upright position before donning harness 100. Once a snap hook or other connector has been attached to D ring, the force of gravity will typically pull D ring 150 into a non-upright, downward or natural position as, for example, illustrated in FIG. 3C. To once again place D ring 150 into an upright position (to, for example, remove a snap hook from connection therewith), a user or wearer of harness 100 can, for example, apply force to a line or lanyard connected to the snap hook to force D ring 150 into an upright position. While maintaining force (for example, an upward force) on the line or the snap hook (or other connector) with one hand, the user can, for example, remove the snap hook from connection with D ring 150 with the other hand of with the same hand.

Figure 4C:
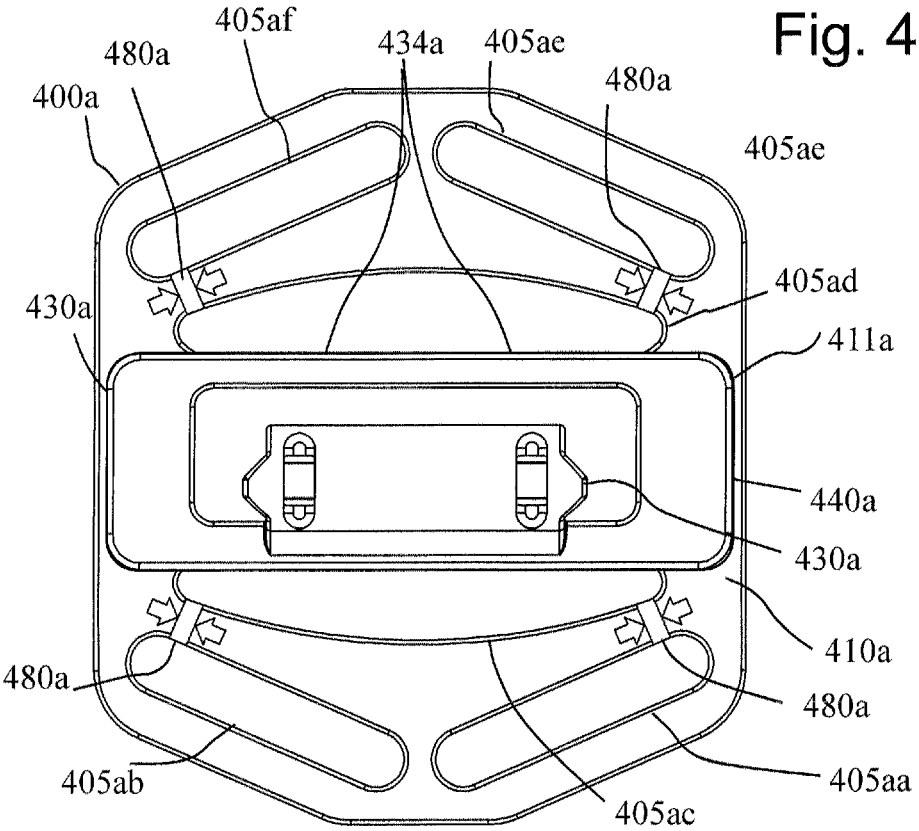
FIG. 4C illustrates a rearward view of the D-ring attachment of FIG. 4B in position for use with the back bad of FIG. 4A.

Existing harnesses can be retrofitted to incorporate an upright D ring mechanism the same as or similar to that illustrated in FIGS. 3A through 3U. In that regard, back pads in current use in commercially available safety harnesses can, for example, be replaced by back pad 400. Moreover, existing safety harnesses and/or back pads for use therewith can be used in connection with a standalone D ring/connector attachment of the present invention to, for example, from a back pad system similar in operation to back pad/back pad system 400. For example, FIG. 4A illustrates a hexagonal D pad 400*a*. FIG. 4B illustrates a separate or standalone upright D-ring attachment 410*a* of the present invention that is similar in operation to D ring attachment 410. D ring attachment 410*a* includes a base 411*a* in which an opening 440*a*, similar in function to opening 440, is formed. D ring attachment 410*a* includes a central portion 420*a* that operates in an identical manner to central portion 420. In general, components of D ring attachment 410*a* are numbered similarly to corresponding or like components of D ring attachment 410 with the addition of the designation "a". A connector attachment such as D-ring attachment 410 can be used in connection with generally any safety harness comprising a connector such as a D-ring, whether or not the safety harness includes a back pad as known in the art.

Figure 5:
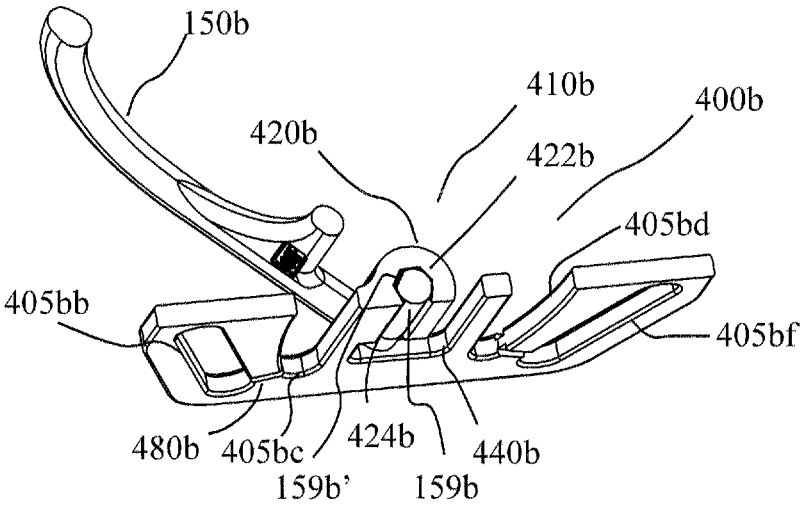
FIG. 5 illustrates a perspective cutaway view of another embodiment of a back pad of the present invention including a D ring attachment including a D ring seating of noncircular cross-section.

Other types of abutment or capture member can be used to capture D ring 150 or another connector in an upright position to facilitate attachment of a connector such as a snap hook thereto. As illustrated, for example, in FIG. 5, a back pad 400*b* can include a passage 422*b* in a central portion 420*b* of a D ring attachment 410*b* having a noncircular cross-section over at least a portion thereof or over the entirety thereof. In the illustrated embodiment, passage 422*b* has a generally hexagonal cross-section. Lower bar 159*b* of D ring 150*b* can have a flattened surface 159*b*' to facilitate positioning thereof in cooperation with noncircular passage 422*b*. In the illustrated embodiment, D ring 150 can be placed in various positions including an upright or connecting position upon application of force (for example, manual force) to D ring 150*b*.

Capture member or abutment members to capture or hold a D ring such as D ring 150 or other similar anchoring connector can also be positioned away from a D ring attachment member. As illustrated in FIGS. 6A through 6C, back pad 400*d* includes an D ring attachment 410*d* that operates similarly to D ring attachment 410. D ring attachment does not include detents 430, however. In that regard, capture members 430*d* are provided on each side of back pad 400 to capture and hold D ring 150 in an upright position. In the embodiment illustrated in, FIGS. 6A and 6B, capture member 430*d* include a generally cylindrical seating 432*d* with which side member 153 of D ring can form a snap fit upon application of force to D ring 150 to move D ring 150 in the upright position as illustrated in FIG. 6A.

In the embodiment illustrated in FIG. 7, a back pad 400*e* can be provided with capture members 430*e* that include flexing detents 432*e* to hold D ring 150 in an upright position upon a application of force to D ring 150 to move D ring 150 in the upright position.

In the case of application of a relatively large force to harness 10 (as, for example, in a fall), the force is transferred to straps 122 and 132 which pass over central portion 420 (or other central portion as described above) when harness 100 is assembled. Under a substantial load, straps 122 and 132 become taut, changing the force exerted upon, for example, back pad 400 (or another back pad or other load indicator of the present invention as described below). Further, back pad 400 is movable relative to straps 122 and 132. Indeed, such movability provides users of various heights and weights with the ability to adjust the position of back pad 400 and D ring 150 to a desirable position for each user. Friction between straps 122 and 132 and back pad 400 typically prevents relative motion between back pad 400 and straps 122 and 132 during normal use. In the case of a fall, straps 122 and 132 become taut as described above. Moreover, back pad 400 slides to a different position. For example, in a foot-first fall, back pad 400 will slide upward (in the direction of the head of the user). In a head first fall, back pad 400 moves downward with respect to the user's body. Once the fall is arrested, the users body is caused to rotate and back pad 400 is caused to slide upward, coming to rest near the head of the user.

Friction between back pad 400 and straps 122 and 132 during movement of back pad 400 can result in heat damage or melting those areas of back pad 400 in contact with straps 122 and 132. Further, movement of back pad 400 in either the upward or downward direction results in movement of back pad 400 in a direction of widening in the separation between straps 122 and 132, thereby increasing the force exerted on back pad 400 (pulling to the outside or tensioning back pad 400).

The increased force associated with increased tautness in straps 122 and 132 (whether, there is movement of back pad 400 relative to straps 122 and 132 or not) can be used to cause a change in the appearance (for example, distension or breaking) of back pad 400. Although a change in appearance can occur in the case of a falls in back pads used in connection with some commercially available safety harnesses, in some cases the change in appearance is insubstantial and can be overlooked. In back pad 400 and other back pads of the present invention, structural stress points or weak points are built into back pad 400 to accentuate the change in appearance of back pad 400 in the case of a large force (for example, a load of at least 500 to 600 pounds of force) such that the change in appearance of back pad 400 is readily apparent in even a cursory inspection.

Figure 3M:
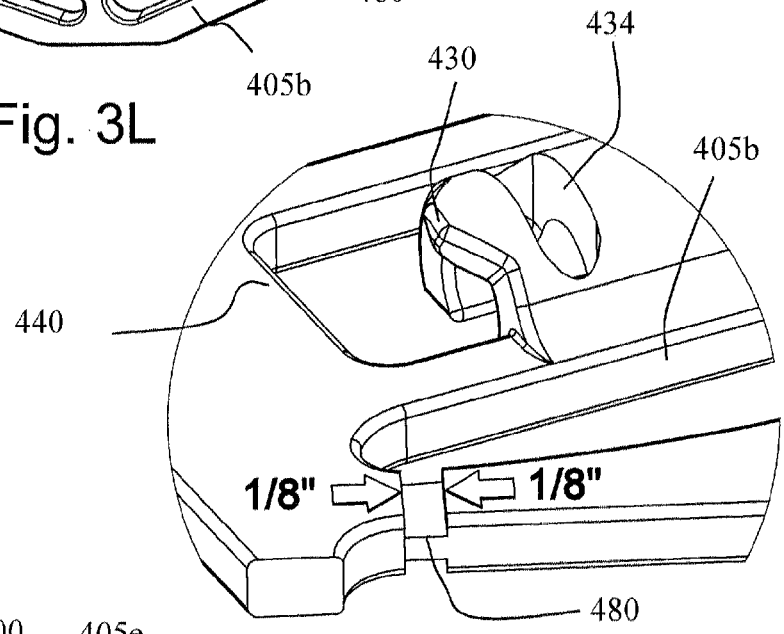
FIG. 3M illustrates an enlarged, rearward perspective view of a portion of the back pad of FIG. 3A illustrating an area of decreased thickness in the back pad to create a stress point to provide a visual indication in the case that the safety harness in connection with which the back pad is used is subjected to a relatively large force or load as would occur in an impact or a fall.
Figure 3N:
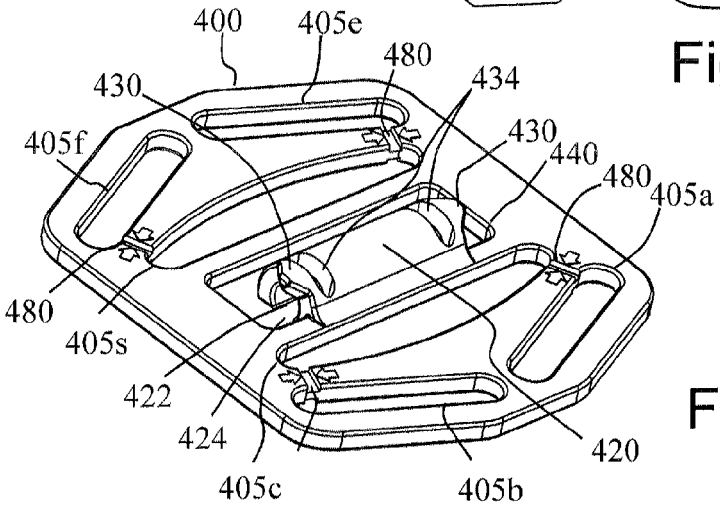
FIG. 3N illustrates another rearward perspective view of the back pad of FIG. 3A wherein the D ring has been removed from connection with the D ring attachment of the back pad.
Figure 3O:
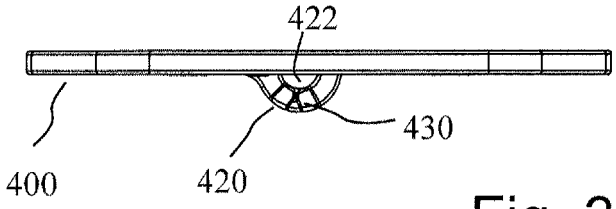
FIG. 3O illustrates a side view of the back pad of FIG. 3A wherein the D ring has been removed from connection with the D ring attachment of the back pad.
Figure 3P:
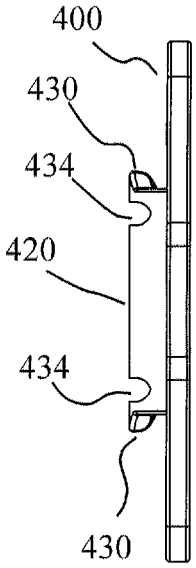
FIG. 3P illustrates a top view of the back pad of FIG. 3A wherein the D ring has been removed from connection with the D ring attachment of the back pad.
Figure 3Q:
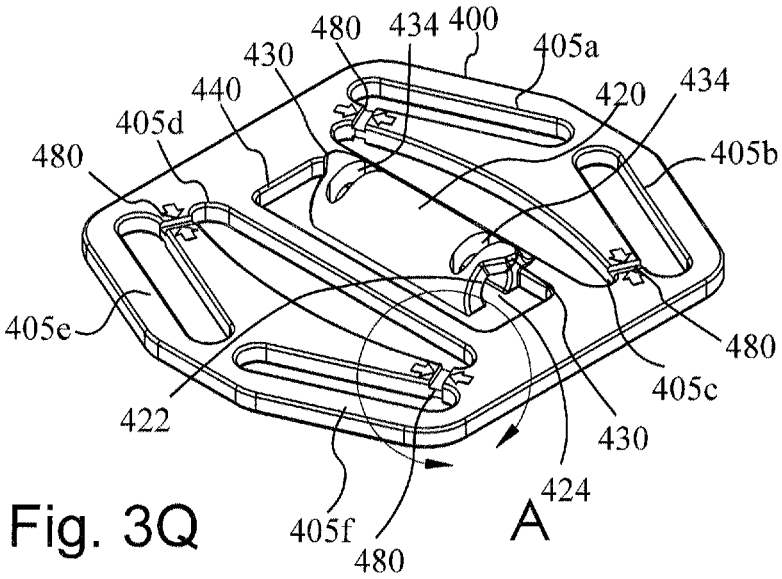
FIG. 3Q illustrates a rearward perspective view of the back pad of FIG. 3A wherein the D ring has been removed from connection with the D ring attachment of the back pad.
Figure 3R:
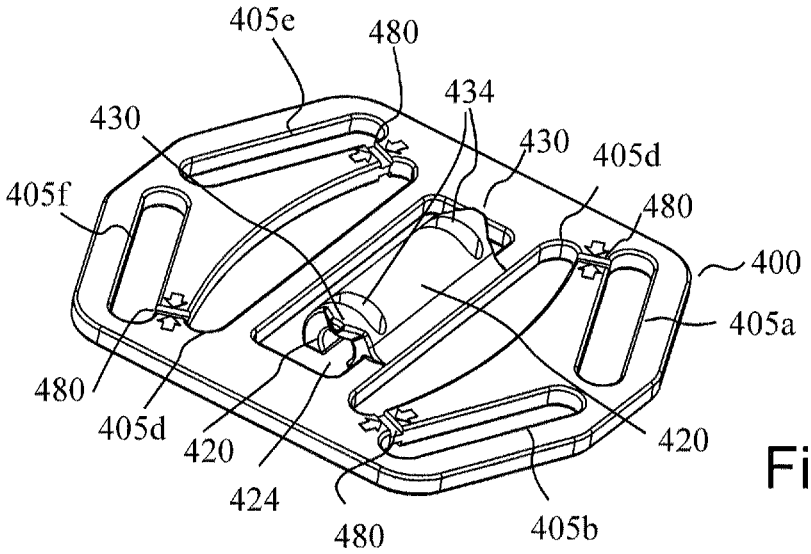
FIG. 3R illustrates another rearward perspective side view of the back pad of FIG. 3A wherein the D ring has been removed from connection with the D ring attachment of the back pad.
Figure 3S:
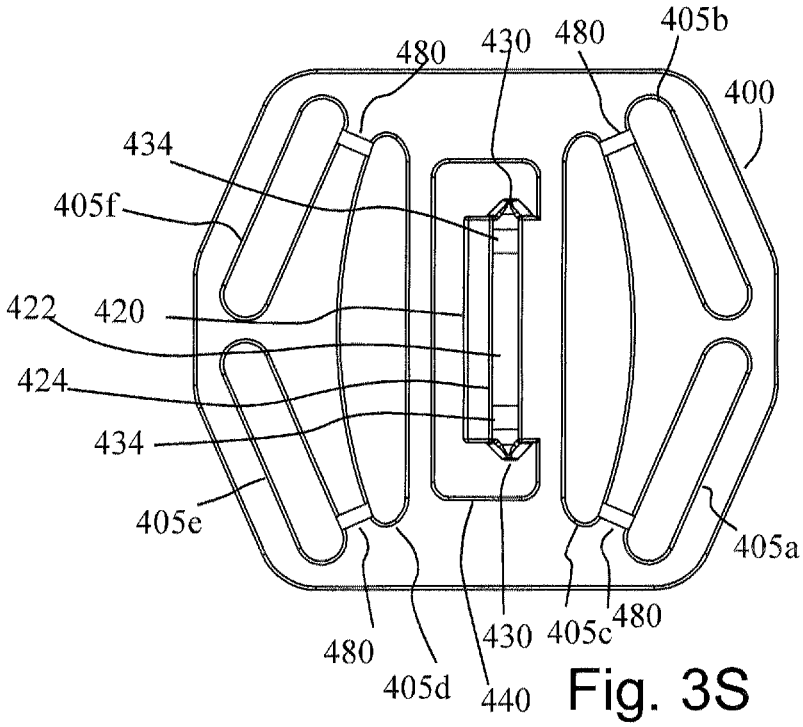
FIG. 3S illustrates a forward view of the back pad of FIG. 3A wherein the D ring has been removed from connection with the D ring attachment of the back pad.

As for example illustrated in FIGS. 3T and 3U, one or more areas 480 of decreased thickness are formed in the material of back pad 400. These areas of decreased thickness, channels or notches 480 create stress points that cause significant distention or stretching, or, more likely, breakage in the case of application of a substantial or large load as described above to safety harness 10. As known to, for example, those in the materials arts, the load under with such distension or breakage occurs can be readily adjusted to a particular predetermined load by, for example, choice of the material or materials of back pad 400 and/or the dimensions of areas 480. Indicators, such as arrows 484 can be provided to further draw attention to relatively thin areas or notches 480 for inspection. In the illustrated embodiment, relatively thin areas, channels or notches 480 are formed between upper and lower slots 405*a, b, e* and *f* and generally central slots 405*c* and *d*. As illustrated in, for example, FIG. 3M, an indication of an unstressed width of channels or notches 480 (for example, ⅛ inch) can be provided as a reference to determine if distention or stressing has occurred.

D-ring attachment 410 (or other D ring attachment of the present invention) will not typically be subjected to a force suitable to damage attachment 410.

As, for example, illustrated by back pad 400*a* FIG. 4A, areas 480*a* can be incorporated into a back pad that does not include a D ring attachment 410 as described above and is not used in connection with a standalone D ring attachment 410*a* as described above. In FIG. 4A, areas 480*a* have been incorporated into the design of a standard hexagonal back pad used in a number of commercially available safety harnesses. Existing safety harness designs are readily retrofitted to incorporate back pad 480*a* as illustrated in FIG. 4A. Moreover, many other back pads or strap guides used in safety harnesses are readily altered to include areas of decreased strength to provide a readily observable indication that a safety harness and thereby the back pad has undergone a predetermined load. Furthermore, the indicators of the present invention can reduce or eliminate false positives associated with many other types of fall indicators (that is, false indications of a fall when there has been no fall).

Further, a load indicator of the present invention need not be incorporated into the back pad of the safety harness. In that regard, a load indicator of the present invention need only be connected between two spaced straps of the safety harness such that the change in force exerted upon the load indicator in the case of a fall causes a readily observable change in appearance of the load indicator. The load indicator can include a first connector that is connected to the first strap and a second connector that is connected to the second strap.

Figure 8A:
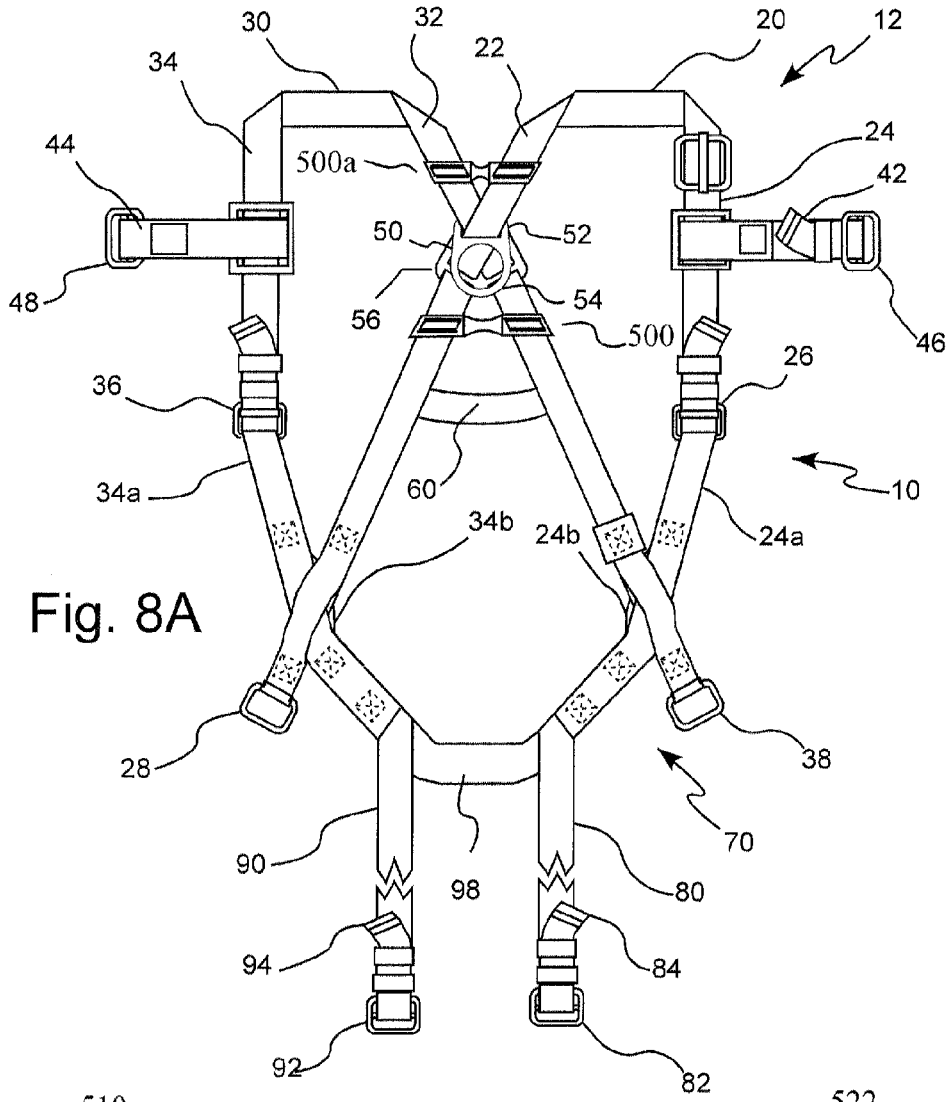
FIG. 8A illustrates the safety harness of FIG. 1 including two examples of another embodiment of a load indicator of the present invention.
Figure 8B:
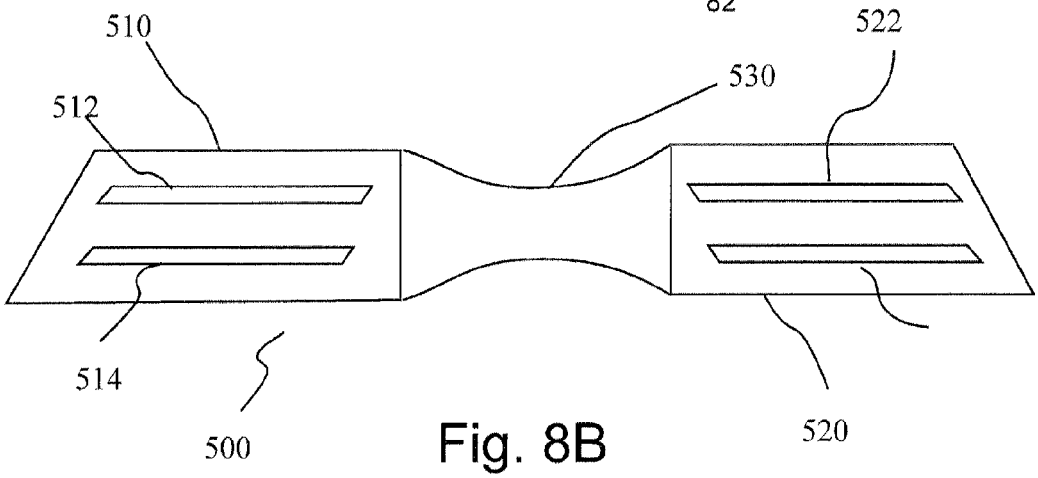
FIG. 8B illustrates a rear view of one of the load indicators of FIG. 8A.

FIGS. 8A and 8B, for example, illustrate a load indicator 500 wherein a first connector 510 includes slots 512 and 514 through which strap 22 of harness 10 passes (see FIG. 8A), and a second connector 520 includes slots 522 and 524 through which strap 22 passes. Connectors 510 and 520 are connected by an intermediate member 530. In the illustrated embodiment, the width of intermediate member decreases near the center thereof to provide a stress point as described above. Depending upon the material(s) chosen for load indicator 500, there may be no need to create one or more stress points. FIG. 8A also illustrates a second load indicator 500*a* that is similar in design and operation to load indicator 500. Load indicator 500*a* is positioned above the position of the crossing point of straps 22 and 32 and load indicator 500 is positioned below the position of the crossing point of straps 22 and 32.

The foregoing description and accompanying drawings set forth preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

The invention claimed is:

1. A back pad system for use in connection with a safety harness having at least two spaced back straps, comprising:

a back pad having passages through which the two back straps can be passed to be crossed over one another adjacent a harness wearer's back, said back pad defining an opening between lateral sides;

a connector adapted to be connected to a line or lanyard, said connector being pivotable within a range around an axis relative to said back pad said connector having opposite side members with lateral sides substantially adjacent to the back pad opening lateral sides at the pivot axis, and a bar extending between from said opposite side members, said bar being pivotally secured in said back pad opening along said axis; and a detent connection between said back pad and said connector capturing said connector in a selected upright position when said connector is manually moved to said selected upright position, wherein said connection has at least one detent member secured to said back pad in said back pad opening, said detent member being adjacent to one of the back pad opening lateral sides, and spaced a selected lateral distance from said one back pad opening lateral side when said connector is pivotably positioned at either end of its range, wherein said selected lateral distance is less than the lateral thickness of the connector side member adjacent said back pad opening one lateral side, and said detent member is laterally flexible away from said back pad opening one lateral side when a selected pivoting force is applied to said connector, whereby said detent member blocks said connector side member adjacent said back panel opening one lateral side from pivoting to thereby secure said connector when in said selected upright position at one end of said range of pivoting unless said selected force is applied to pivot said connector away from said selected upright position.

2. The back pad system of claim 1 wherein the back pad includes a seating adapted to pivotably secure said bar of the connector so that the connector is pivotably about the axis relative to the connector attachment.

3. The back pad system of claim 2 wherein the detent connection further comprises a second detent member on the other lateral side of the back pad seating, the second detent member being adjacent to the other of the back pad opening lateral sides, and spaced said selected lateral distance from the other back pad opening lateral side when said connector is pivotably positioned at either end of its range, wherein said selected lateral distance is less than the lateral thickness of the connector side member adjacent said back pad opening other lateral side, and laterally flexible away from said back pad opening other lateral side when a selected pivoting force is applied to said connector, whereby said first and second detent members block said connector side members from pivoting to thereby secure said connector when in said selected upright position at one end of said range of pivoting unless said selected force is applied to pivot said connector away from said selected upright position.

4. The back pad system of claim 1 wherein the back pad comprises at least one load indicator comprising an area of reduced strength so that the area visibly distends or breaks upon the safety harness being subjected to a substantial load.

5. A connector for a safety harness comprising:

a back pad securable to the safety harness in a position having one side substantially facing the back of a wearer, said back pad defining an opening between lateral sides;

a connector adapted to be connected to a line or lanyard, said connector being pivotable within a range around an axis relative to the side opposite said one side of said back pad, said connector having opposite side members with lateral sides substantially adjacent to the back pad opening lateral sides at the pivot axis, and a bar extending between from said opposite side members, said bar being pivotally secured in said back pad opening along said axis; and a detent connection between said back pad and said connector capturing said connector in a predetermined upright position when said connector is manually moved to said selected upright position, wherein said connection has at least one detent member secured to said back pad in said back pad opening, said detent member being adjacent to one of the back pad opening lateral sides, and spaced a selected lateral distance from said one back pad opening lateral side when said connector is pivotably positioned at either end of its range, wherein said selected lateral distance is less than the lateral thickness of the connector side member adjacent said back pad opening one lateral side, and said detent member is laterally flexible away from said back pad opening one lateral side when a selected pivoting force is applied to said connector, whereby said detent member blocks said connector side member adjacent said back panel opening one lateral side from pivoting to thereby secure said connector when in said selected upright position at one end of said range of pivoting unless said selected force is applied to pivot said connector away from said selected upright position.

6. The connector of claim 5 wherein the back pad includes a seating adapted to pivotably secure said bar of the connector so that the connector bar is pivotable about the axis relative to the connector attachment.

7. The connector of claim 6 wherein the detent connection further comprises a second detent member on the other lateral side of the back pad seating, the second detent member being adjacent to the other of the back pad opening lateral sides, and spaced said selected lateral distance from the other back pad opening lateral side when said connector is pivotably positioned at either end of its range, wherein said selected lateral distance is less than the lateral thickness of the connector side member adjacent said back pad opening other lateral side, and laterally flexible away from said back pad opening other lateral side when a selected pivoting force is applied to said connector, whereby said first and second detent members block said connector side members from pivoting to thereby secure said connector when in said selected upright position at one end of said range of pivoting unless said selected force is applied to pivot said connector away from said selected upright position.

8. The connector of claim 5 wherein the back pad comprises at least one load indicator comprising an area of reduced strength so that the area visibly distends or breaks upon the safety harness being subjected to a substantial load.

9. The back pad system of claim 1, wherein said bar is a longitudinal unitary bar.

10. The back pad system of claim 5, wherein said bar is a longitudinal unitary bar.

11. A connector for a safety harness, comprising:

a D-ring connector having a longitudinal bar extending between lateral sides of said connector;

a back pad having a first side capable of substantially facing the back of a wearer, said back pad having an opening therethrough having a front and a rear extending between lateral sides, a pivot support between said lateral sides, said pivot support extending partially from said back pad opening front to said back pad opening rear, a first detent member extending laterally outwardly from said pivot support toward one of said back pad opening lateral sides, said first detent member being laterally flexible away from said back opening one lateral side;

wherein said connector bar is secured to said pivot support for pivoting relative to said back pad about a pivot axis and secured against motion along the pivot axis and said pivot support is substantially as long as the connector longitudinal bar.

12. The connector of claim 11, wherein said pivot support includes a first expansion slot adjacent said first detent member allowing said first detent member to move away from said back pad opening one lateral side.

13. The connector of claim 11, wherein said back pad opening lateral sides are spaced apart a distance substantially equal to the width of the connector at the longitudinal bar.

14. The connector of claim 11, wherein said pivot support is spaced from said back pad opening rear a distance sufficient to allow the connector to pass therethrough and has a groove defining the pivot axis, said groove being open toward said back pad first side, wherein said connector is secured to said back pad by passing all but said connector longitudinal bar through the spacing between the pivot support and the back pad opening rear and then inserting the connector longitudinal bar in the pivot support groove.

15. The connector of claim 14, wherein said longitudinal bar is snap fit in said pivot support groove.

16. The connector of claim 11, wherein said connector pivots relative to said back pad within a range, and said first detent member releasably maintains said connector in a selected position away from said back pad at one end of said range.

17. The connector of claim 11, further comprising a second detent member extending laterally outwardly from said pivot support toward the other of said back pad opening lateral sides, said second detent member being laterally flexible away from said back pad opening other lateral side.

18. The connector of claim 17, further comprising:

a first expansion slot adjacent said first detent member allowing said first detent member to move away from said back pad opening one lateral side; and a second expansion slot in said pivot support adjacent said second detent member allowing said second detent member to move away from said back pad opening other lateral side.

* * * * *